US006039119A

United States Patent [19]

Hopper et al.

[11] Patent Number: 6,039,119

[45] **Date of Patent: *Mar. 21, 2000**

[54] COMPLETION SYSTEM

[75] Inventors: Hans Paul Hopper, Hill House White Rashers; Thomas G. Cassity, Tyronos Sandy Lane Cobham, both of United Kingdom

[73] Assignee: Cooper Cameron Corporation, Houston, Tex.

[ * ] Notice: This patent is subject to a terminal disclaimer.

[21] Appl. No.: 08/679,560

[22] Filed: Jul. 12, 1996

Related U.S. Application Data

[63] Continuation of application No. 08/204,397, filed as application No. PCT/US93/05246, May 28, 1993, Pat. No. 5,544,707.

[30] Foreign Application Priority Data

Jun. 1, 1992 [EP] European Pat. Off. ..... 92305014

[51] Int. Cl.[7] ..... E21B 33/03

[52] U.S. Cl. ..... 166/368; 166/88.4; 166/95.1; 166/348; 166/382

[58] Field of Search ..... 166/382, 368, 166/348, 339, 341, 347, 88, 89, 95, 208, 88.4, 95.1

[56] References Cited

U.S. PATENT DOCUMENTS

| | | | |
|---|---|---|---|
| 2,094,812 | 10/1937 | Penick et al. | 166/15 |
| 2,118,094 | 5/1938 | McDonough | 166/15 |
| 2,148,360 | 2/1939 | Lemley | 166/14 |
| 2,590,688 | 3/1952 | Crain | 166/15 |
| 2,889,886 | 6/1959 | Gould | 166/89 |
| 2,965,174 | 12/1960 | Haeber | 166/46 |
| 3,041,090 | 6/1962 | Ashe et al. | 135/137 |
| 3,043,371 | 7/1962 | Rector | 166/86 |
| 3,064,735 | 11/1962 | Bauer et al. | 166/66.5 |
| 3,090,640 | 5/1963 | Otteman et al. | 285/3 |
| 3,098,525 | 7/1963 | Haeber | 166/66.5 |
| 3,139,932 | 7/1964 | Johnson | 166/95 |
| 3,236,308 | 2/1966 | Leake | 166/46 |
| 3,279,536 | 10/1966 | Wakefield, Jr. | 166/5 |
| 3,295,600 | 1/1967 | Brown et al. | 166/348 |
| 3,299,958 | 1/1967 | Todd | 166/89 |
| 3,310,107 | 3/1967 | Yancey | 166/348 |
| 3,331,437 | 7/1967 | Jones | 166/6 |
| 3,332,481 | 7/1967 | Wakefield | 166/6 |
| 3,414,056 | 12/1968 | Brown et al. | 166/89 |

(List continued on next page.)

FOREIGN PATENT DOCUMENTS

| | | |
|---|---|---|
| 0132891 | 2/1985 | European Pat. Off. . |
| 0534584 | 3/1996 | European Pat. Off. . |
| 0489142 | 1/1997 | European Pat. Off. . |
| 625021 | 8/1978 | U.S.S.R. . |
| 1244285 | 7/1986 | U.S.S.R. . |
| 1659625 | 6/1991 | U.S.S.R. . |
| 2166775 | 5/1977 | United Kingdom . |
| 1494301 | 12/1977 | United Kingdom . |
| 2192921 | 1/1988 | United Kingdom . |
| 8603799 | 3/1986 | WIPO . |
| WO 8601852 | 3/1986 | WIPO . |
| 9200438 | 1/1992 | WIPO . |

OTHER PUBLICATIONS

John R. Keville letter to Lester L. Hewitt; Jan. 14, 1999 (2 p.).

Declaration of Sigbjorn Sangesland; Undated; (13 p.).

Subsea Production Technology; Oct. 23–27, 1989 and Nov. 20–24, 1989; (3 p.).

Subsea 91 International Conference, Delegate & Exhibitor List 1991 (7 p.).

(List continued on next page.)

*Primary Examiner*—Hoang C. Dang

*Attorney, Agent, or Firm*—Conley, Rose & Tayon, P.C.

[57] ABSTRACT

A wellhead has, instead of a conventional Christmas tree, a spool tree (34) in which a tubing hanger (54) is landed at a predetermined angular orientation. As the tubing string can be pulled without disturbing the tree, many advantages follow, including access to the production casing hanger (21) for monitoring production casing annulus pressure, and the introduction of larger tools into the well hole without breaching the integrity of the well.

37 Claims, 16 Drawing Sheets

U.S. PATENT DOCUMENTS

| | | | |
|---|---|---|---|
| 3,454,084 | 7/1969 | Sizer | 166/0.6 |
| 3,457,992 | 7/1969 | Brown | 166/0.6 |
| 3,542,125 | 11/1970 | Sizer | 166/368 X |
| 3,545,541 | 12/1970 | DeVries | 166/95 |
| 3,552,903 | 1/1971 | Townsend | 166/5 |
| 3,602,303 | 8/1971 | Bienkarn et al. | 166/368 |
| 3,638,725 | 2/1972 | Ahlstone | 166/226 |
| 3,638,732 | 2/1972 | Huntsinger et al. | 166/315 |
| 3,663,822 | 5/1972 | Wakefield, Jr. | 166/368 X |
| 4,053,023 | 10/1977 | Herd et al. | 175/7 |
| 4,130,161 | 12/1978 | Jones | 166/337 |
| 4,154,302 | 5/1979 | Cugini | 166/315 |
| 4,289,199 | 9/1981 | McGee | 166/65 |
| 4,436,148 | 3/1984 | Maxwell | 166/53 |
| 4,491,176 | 1/1985 | Reed | 166/65 |
| 4,629,003 | 12/1986 | Baugh | 166/341 |
| 4,903,774 | 2/1990 | Dykes et al. | 166/363 |

OTHER PUBLICATIONS

Claim Chart for Claim 10; Undated; (3 p.).

Technical Opinion by Bruce C. Volkert; Jan. 10, 1999; (11 p.).

John R. Keville letter to Lester L. Hewitt; Feb. 5, 1999, (8 p.).

Claim Charts for Claims 16, 112, 110, 91; Undated; (8 p.).

Annotated Figures 1–3; Undated; (3 p.).

Cooper Cameron Admissions 152–153; Undated; (1 p.).

Depostion of Norman Brammer; Sep. 18, 1998; (3 p.).

Depostion of Peter Scott; Sep. 18, 1998; (5 p.).

Claim Charts for Claims 16, 112, 91, (4 p.).

Declaration of Sigbjorn Sangesland; Undated; (76 p.).

Claim Chart for Claim 110; Undated; (1 p.).

Cooper Cameron Admisssions 126–133; Undated; (5 p.).

Depostion of Peter Doyle; Jul. 28, 1999; (pp. 131–142, 179–182).

Deposition of Norman Brammer; (pp. 159–166).

Memorandum and Order; Feb. 19, 1999; (29 p.).

Norwegian Petroleum Directorate regulations Table of Contents and Sections 23–27, (4 p.), Jan. 20, 1997.

Norwegian Petroleum Directorate guidelines Table of Contents and Sections 2.1.3–2.3.3 and 3.2.2–3.7.1, (7 p.), Feb. 7, 1992.

Memorandum of Inventorship Contentions; Dec. 23, 1998; (5 p.).

Cooper Oil Tool; *Phillips Petroleum Company Ann Subsea Facility*; TMH0445, Nov. 1991; (pp. CCH 36064–36223).

SISL Subsea Submersible Pumping (S.S.P.), *Second Interim Report–Technical Jun. 1991, Project No. TH/03328/89; Projects of Technological Development in the Hydrocarbons Sector (Regulation EEC 3639/85); KAS 10837–10970; Jun. 1991.*

Vetco Gray; Drawings of Shell Tazerka MSP Production Tree with Tubing Hanger Spool; (1 page); undated.

Cooper Cameron; Layout Drawing of Spool Tree Arrangement for Texaco; (1 page); undated.

Cooper Cameron; Drawing of ESP Tree Arrangement for Amoco; (1 page); Dec. 18, 1989.

Cooper Cameron; Drawings of Production System Assembly—Electrical Submersible Pump for Amoco Orient re: Liuhua 11–1; (2 pages); undated.

Framo Engineering; Drawings of ESP Subsea System; (2 pages); undated.

National Oilwell Bulletin No. 186; *Mudline Subsea Completion Systems*; (4 pages); 1991.

Cameron Iron Works USA, Inc.; *Subsea Completion System with Downhole—ESP Conceptual Design Study*; Feb. 1990; (pp. AMO 02992–AMO 03130).

Document No. SSP–020–001 and 2; SISL Project Team; *Subsea Submersible Pumping Project Task Series 1000 Equipment Evaluations*; (p. KAS09939–KAS10023); Undated.

Document No. SSP–020–021; Subsea Intervention Systems Ltd.; *Subsea Submersible Pumping Project*; Final Report vol. 1, 2 and 3; (pp. KAS10024–KAS10694); Jun. 29, 1992.

Letter from Kvaerner Oilfield Products dated Jan. 16, 1998 re: Spool Tree Continuation Patent Application.

Document No. SSP–020–004; SISL Project Team; *Conceptual Design Report Task Series 2000*; Jan. 1991.

American Petroleum Institute; API Recommendation Practice 17A Second Edition, Sep. 1996 (Effective Date: Dec. 1, 1996); *Recommended Practice for Design and Operation of Subsea Production Systems.*

Division of Petroleum Engineering and Applied Geophysics; NTH. Trondheim; Mar. 1990; *A Simplified Subsea System Design*; Sigbjorn Sangesland; (pp. 1–18).

SPE 23050 *Electrical Submersible Pumps in Subsea Completions*; Sep. 3–6, 1991; P.A. Scott, M. Bowring, B. Coleman.

National Oilwell (UK) Limited; *Through Bore Tree System*; Jan. 1993; St. Magnus House.

Offshore Technology Conference (OTC 5689); *The Subsea Systems of the Argyll Area Fields*; D.S. Huber, R.C. Burnett; May 2–5, 1988; (pp. 81–90).

Offshore Technology Conference (OTC 5885); *Detail Design of a Guidelineless Subsea Satellite Completion*; H. B. Skeels, J.A. Martins, S.P. Singeethaml; May 1–4, 1989; (pp. 39–50).

Offshore Technology Conference (OTC 5887) *Deepwater Christmas Tree Development*; P. P. Alfano, C.H.N. Barbosa, M.A. Lewis; May 1–4, 1989; (pp. 57–65).

Offshore Technology Conference (OTC 6085); *High–Performance Metal–Seal System for Subsea Wellhead Equipment*; L. J. Milberger, C.F. Boehm; May 1–4, 1989; (pp. 411–422).

Offshore Technology Conference (OTC 6388); *Subsea Trees and Controls for Australian Bass Strait Development*; L. A. Gillette, R.K. Voss Jr., T. Goggans; May 7–10, 1990; (pp. 391–397).

Offshore Technology Conference (OTC 7065); *A High–Voltage System for Subsea Electrical Submersible Pumping*; Neil Duncan, P.A. Scott, E.R. Schweim,; May 4–7, 1992; (pp. 701–705).

SPE 16847; *Equipment Selection Procedure for Subsea Trees*; J. D. Otten, N. Brammer; Sep. 27–30, 1987; (pp. 121–130).

SPE 19288; *Don A Cost Effective Approach to Subsea Design*; B. Stoddard, J.J. Campbell; Sep. 5–8, 1989; (pp. 1–11).

American Petroleum Institute; RP 17A; *Recommended Practice for Design and Operation of Subsea Production Systems*; American Petrolium Institute 1987; (p. 88) In particular See pp. 15–20.

The American Society of Mechanical Engineers; *The Development of the 7–1/16" Through–Bore Christmas Tree*; D.S. Hubner, et al.; (undated); (pp. 99–106).

Underwater Technology Conference; *Subsea Production Systems: The Search for Cost–Effective Technology*; Mar. 19–21, 1990; (p. 15).

Division of Petroleum Engineering and Applied Geophysics, NTH; *Simplified Subsea System Design*; Oct. 23–27, 1989; (pp. 2–32).
Subsea Intervention Systems Ltd.; *Subsea Applications for Downhole Pumping*; M. Bowring, et al; DOT 1991; (pp. 71–78).
Design Certification Manuals; Jul. 29, 1986.
Subsea Wells; A Viable Development Alternative; *Ocean Industry*; Nov. 1986 (p. 1).
SPE 11176; *New Generation 18–3/4–in.–15,000–psi Subsea Wellhead System*; Sep. 26–29, 1982; B.F. Baugh, C.R. Gordon, G.C. Weiland.
National Supply Company (UK) Limited; *Through Bore Tree system and Workover Riser 7–1/16" 5000 psi*; Jun. 1985.
National Supply Company (UK) Limited; *Through Bore Tree system and Workover Riser 7–1/16"–5M*; Oct. 1985.
OTC 5847; *Subsea Template and Trees for Green Canyon Block 29 Development*; May 2–5, 1988; M.L. Teers, T.M. Stroud, A.J. Masciopinto.
OTC 5809; *Critical Points for the Project of Very Deep Subsea Completions*; May 2–5, 1988; J.M. Formigli Filho, O.J.S. Ribeiro.
Oil & Gas Journal; *Completion Techniques Report*; B.F. Baugh; 1989.
Oil & Gas Journal; *Offshore Report*; B.F. Baugh; May 1989.
*Concentric Tubing Hanger Designs for BP's Universal Subsea Wellhead*; H.P. Hopper; undated.
SPE 23145; *Installation of Concentric Subsea Completions From a Jack–Up in the Welland Field: A Case History*; Sep. 3–6, 1991; R. O. Sanders (pp. 405–415) (15 sheets drawings).
SPE 23045; *Snorre Subsea Tree and Completion Equipment*; Sep. 3–6 1991; J.D. Williams, S. Ytreland; (pp. 149–157).
SPE 16847; *Equipment Selection Procedure for Subsea Trees*; Sep. 27–30, 1987; J.D. Otten, N. Brammer; (pp. 121–130).
Mathias Owe; Div. Of Machine Design; *Electrical Submersible Pump for Subsea Completed Wells*; Dec. 1991; (p. 2).
The Nordic Council of Ministers Program for Petroleum Technology; *Electric Submersible Pump for Subsea Completed Wells*; Nov. 26–27, 1991; S. Sangesland; (p. 17).
Declaration of Roger Moore regarding the Amoco engineering study; 1989.
The American Oil & Gas Reporter; Special Report: Offshore & Subsea Technology; *Horizontal Tree Gives Access to Subsea*; Jun. 1996.
SPE 13976 *Through Bore Subsea Christmas Trees*; Sep. 1985; D.S. Huber, G. F. Simmers and C. S. Johnson.
OTC 7063 IUHUA11–1 Field Development; *An Innovative Application of Technology*; May 1992; A. R. Baillie and Jing Hui Chen.
National Well Control Systems—ARMCO National Supply Co.; 1982–83 Composite Catalog.
National Subsea Equipment; 1986–87 Composite Catalog.
Hydrill Mechanical Products Division; 1986–87 Composite Catalog.

35
34
73
70
72
71
40A
38
37
36
26
21
20

COMPLETION SYSTEM

This is a continuation of copending application Ser. No. 08/204,397 filed on Mar. 16, 1994 now U.S. Pat. No. 5,544,707, which claims the benefit of PCT application PCT/US93/05246 filed on May 28, 1993, which claims the priority of European Patent Office application 92305014 filed on Jun. 1, 1992.

Conventionally, wells in oil and gas fields are built up by establishing a wellhead housing, and with a drilling blow out preventer stack (BOP) installed, drilling down to produce the well hole whilst successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

A further difficulty which exists, particularly with subsea wells, is in providing the proper angular alignment between the various functions, such as fluid flow bores, and electrical and hydraulic lines, when the wellhead equipment, including the tubing hanger, Christmas tree, BOP stack and emergency disconnect devices are stacked up. Exact alignment is necessary if clean connections are to be made without damage as the devices are lowered into engagement with one another. This problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further misalignments can arise from the manner in which the guide base is bolted to the conductor casing of the wellhead.

In accordance with the present invention, a wellhead comprises a wellhead housing; a spool tree fixed and sealed to the housing, and having at least a lateral production fluid outlet port connected to an actuated valve; and a tubing hanger landed within the spool tree at a predetermined angular position at which a lateral production fluid outlet port in the tubing hanger is in alignment with that in the spool tree.

With this arrangement, the spool tree, takes the place of a conventional Christmas tree but differs therefrom in having a comparatively large vertical through bore without any internal valves and at least large enough to accommodate the tubing completion. The advantages which are derived from the use of such spool tree are remarkable, in respect to safety and operational benefits.

Thus, in workover situations the completion, consisting essentially of the tubing string, can be pulled through a BOP stack, without disturbing the spool tree and hence the pressure integrity of the well, whereafter full production casing drift access is provided to the well through the large bore in the spool tree. The BOP can be any appropriate workover BOP or drilling BOP of opportunity and does not have to be one specially set up for that well.

Preferably, there are complementary guide means on the tubing hanger and spool tree to rotate the tubing hanger into the predetermined angular position relatively to the spool tree as the tubing hanger is lowered on to its landing. With this feature the spool tree can be landed at any angular orientation onto the wellhead housing and the guide means ensures that the tubing string will rotate directly to exactly the correct angular orientation relatively to the spool tree quite independently of any outside influence. The guide means to control rotation of the tubing hanger into the predetermined angular orientation relatively to the spool tree may be provided by complementary oblique edge surfaces one facing downwardly on an orientation sleeve depending from the tubing hanger the other facing upwardly on an orientation sleeve carried by the spool tree.

Whereas modern well technology provides continuous access to the tubing annulus around the tubing string, it has generally been accepted as being difficult, if not impossible, to provide continuous venting and/or monitoring of the pressure in the production casing annulus, that is the annulus around the innermost casing string. This has been because the production casing annulus must be securely sealed whist the Christmas tree is fitted in place of the drilling BOP, and the Christmas tree has only been fitted after the tubing string and hanger has been run in, necessarily inside the production casing hanger, so that the production casing hanger is no longer accessible for the opening of a passageway from the production casing annulus. However, the new arrangement, wherein the spool tree is fitted before the tubing string is run in provides adequate protected access through the BOP and spool tree to the production casing hanger for controlling a passage from the production casing annulus.

For this purpose, the wellhead may include a production casing hanger landed in the wellhead housing below the spool tree; an isolation sleeve which is sealed at its lower end to the production casing hanger and at its upper end to the spool tree to define an annular void between the isolation sleeve and the housing; and an adapter located in the annular space and providing part of a passage from the production casing annulus to a production casing annulus pressure monitoring port in the spool tree, the adapter having a valve for opening and closing the passage, and the valve being operable through the spool tree after withdrawal of the isolation sleeve up through the spool tree. The valve may be provided by a gland nut, which can be screwed up and down within a body of the adapter to bring parts of the passage formed in the gland nut and adapter body, respectively, into and out of alignment with one another. The orientation sleeve for the tubing hanger may be provided within the isolation sleeve.

Production casing annulus pressure monitoring can then be set up by method of completing a cased well in which a production casing hanger is fixed and sealed by a seal assembly to a wellhead housing, the method comprising, with BOP installed on the housing, removing the seal assembly and replacing it with an adapter which is manipulatable between configurations in which a passages from the production casing annulus up past the production casing hanger is open or closed; with the passage closed, removing the BOP and fitting to the housing above the production casing hanger a spool tree having an internal landing for a tubing hanger; installing a BOP on the spool tree; running a tool down through the BOP and spool tree to manipulate the valve and open the passage; inserting through the BOP and spool tree an isolation sleeve, which seals to both the production casing and spool tree and hence defines between the sleeve and casing an annular void through which the passage leads to a production casing annulus pressure monitoring port in the spool tree; and running a tubing string down through the BOP and spool tree until the tubing hanger lands in the spool tree with lateral outlet ports in the tubing hanger and spool tree for production fluid flow, in alignment with one another.

According to a further feature of the invention the spool tree has a downwardly depending location mandrel which is a close sliding fit within a bore of the wellhead housing. The close fit between the location mandrel of the spool tree and the wellhead housing provides a secure mounting which transmits inevitable bending stresses to the housing from the heavy equipment, such as a BOP, which projects upwardly from the top of the wellhead housing, without the need for excessively sturdy connections. The location mandrel may be formed as an integral part of the body of the spool tree, or may be a separate part which is securely fixed, oriented and sealed to the body.

Pressure integrity between the wellhead housing and spool tree may be provided by two seals positioned in series one forming an environmental seal (such as an AX gasket) between the spool tree and the wellhead housing, and the other forming a production seal between the location mandrel and either the wellhead housing or the production casing hanger.

During workover operations, the production casing annulus can be resealed by reversing the above steps, if necessary after setting plugs or packers down hole.

When production casing pressure monitoring is unnecessary, so that no isolation sleeve is required, the orientation sleeve carried by the spool tree for guiding and rotating the tubing hanger down into the correct angular orientation may be part of the spool tree location mandrel itself.

Double barrier isolation, that is to say two barriers in series, are generally necessary for containing pressure in a well. If a spool tree is used instead of a conventional Christmas tree, there are no valves within the vertical production and annulus fluid flow bores within the tree, and alternative provision must be made for sealing the bore or bores through the top of the spool tree which provide for wire line or drill pipe access.

In accordance with a further feature of the invention, at least one vertical production fluid bore in the tubing hanger is sealed above the respective lateral production fluid outlet port by means of a removable plug, and the bore through the spool tree being sealed above the tubing hanger by means of a second removable plug.

With this arrangement, the first plug, takes the function of a conventional swab valve, and may be a wireline set plug. The second plug could be a stopper set in the spool tree above the tubing hanger by, e.g., a drill pipe running tool. The stopper could contain at least one wireline retrievable plug which would allow well access when only wire line operations are called for. The second plug should seal and be locked internally into the spool tree as it performs a barrier to the well when a BOP or intervention module is deployed. A particular advantage of this double plug arrangement is that, as is necessary to satisfy authorities in some jurisdictions, the two independent barriers are provided in mechanically separate parts, namely the tubing hanger and its plug and the second plug in the spool tree.

A further advantage arises if a workover port extends laterally through the wall of the spool tree from between the two plugs; a tubing annulus fluid port extends laterally through the wall of the spool tree from the tubing annulus; and these two ports through the spool tree are interconnected via an external flow line containing at least one actuated valve. The bore from the tubing annulus can then terminate at the port in the spool tree and no wireline access to the tubing annulus bore is necessary through the spool tree as the tubing annulus bore can be connected via the interplug void to choke or kill lines, i.e. a BOP annulus, so that downhole circulation is still available. It is then only necessary to provide wireline access at workover situations to the production bore or bores. This considerably simplifies workover BOP and/or riser construction. When used in conjunction with the plug at the top of the spool tree, the desirable double barrier isolation is provided by the spool tree plug over the tubing hanger, or workover valve from the production flow.

When the well is completed as a multi production bore well, in which the tubing hanger has at least two vertical production through bores each with a lateral production fluid flow port aligned with the corresponding port in the spool tree, at least two respective connectors may be provided for selective connection of a single bore wire line running tool to one or other of the production bores, each connector having a key for entering a complementary formation at the top of the spool tree to locate the connector in a predetermined angular orientation relatively to the spool tree. The same type of alternative connectors may be used for providing wireline or other running tool access to a selected one of a plurality of functional connections, e.g. electrical or hydraulic couplings, at the upper end of the tubing hanger.

The development and completion of a subsea wellhead in accordance with the present invention are illustrated in the accompanying drawings, in which.

Figure 1:
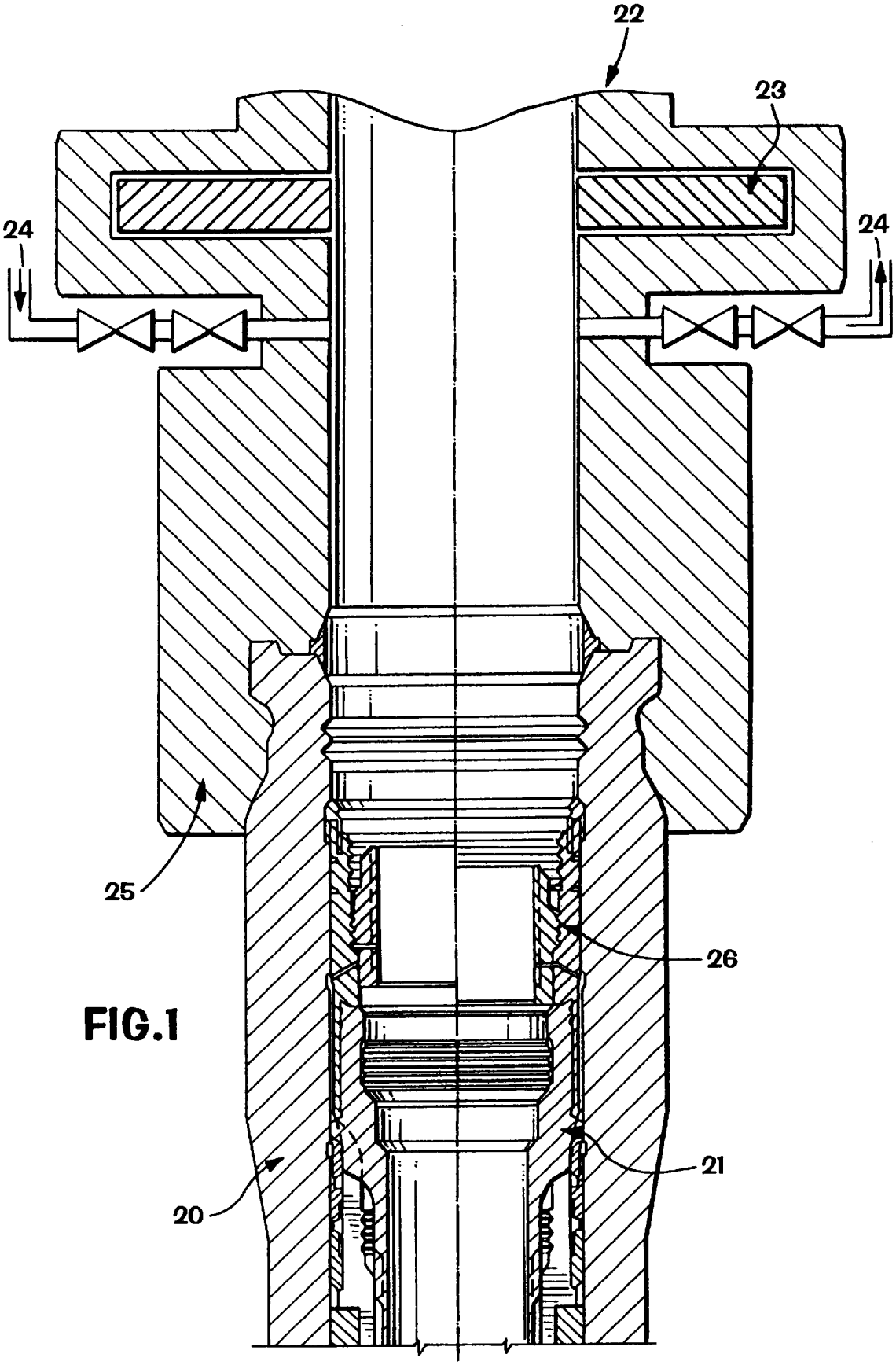
FIGS. 1 to 8 are vertical axial sections showing successive steps in development and completion of the wellhead, the Figure numbers bearing the letter A being enlargements of part of the corresponding Figures of same number without the A.

FIG. 1 shows the upper end of a cased well having a wellhead housing 20, in which casing hangers, including an uppermost production casing hanger 21 for, for example, 9 ⅝" or 10 ¾", production casing is mounted in conventional manner. FIG. 1 shows a conventional drilling BOP 22 having rams 23 and kill and choke lines 24 connected to the upper end of the housing 20 by a drilling connector 25.

Figure 1A:
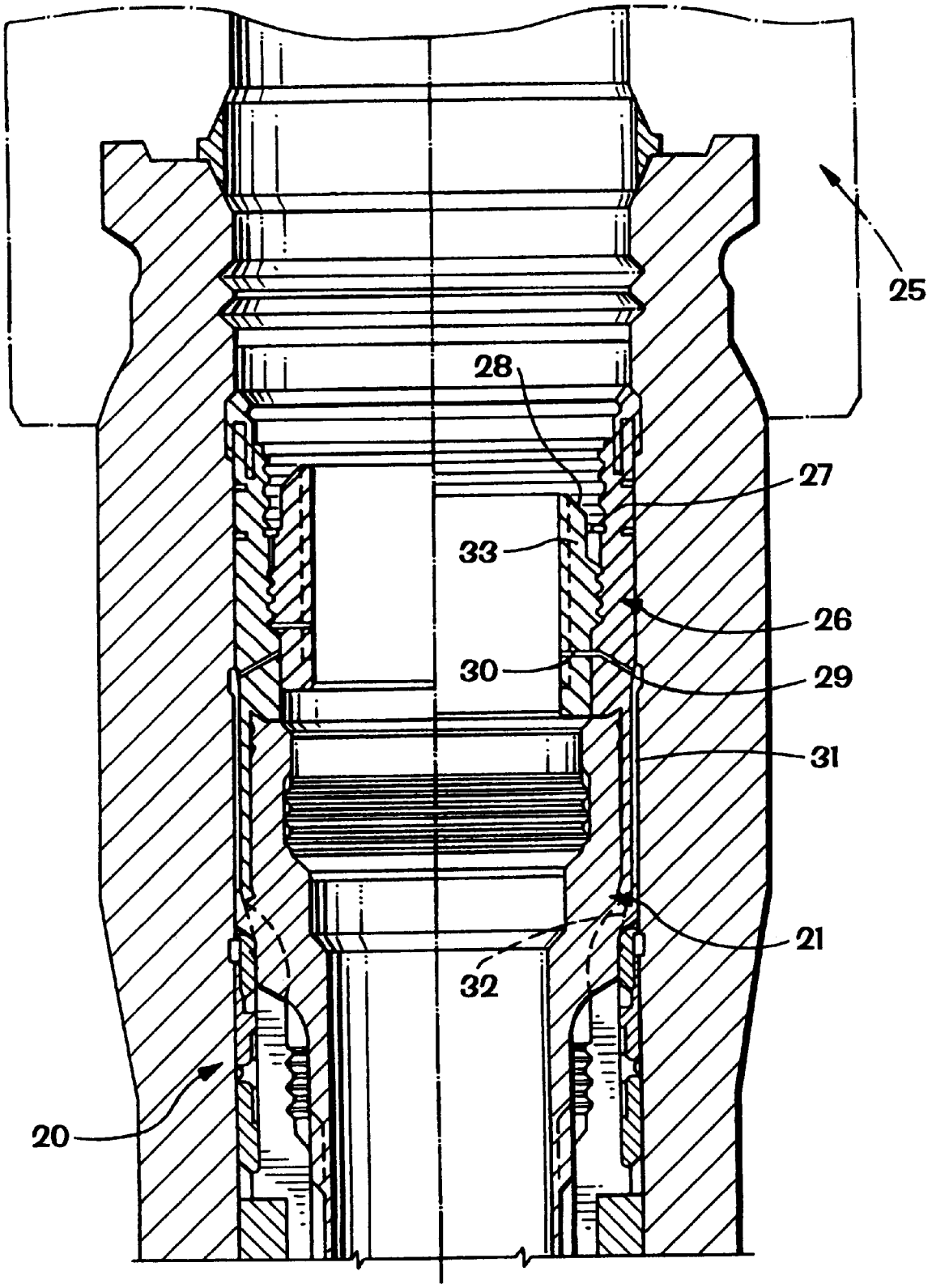

As seen in more detail in FIG. 1A, the usual mechanical seal assemblies between the production casing hanger 21 and the surrounding wellhead housing 20 have been removed and replaced through the BOP with an adapter 26 consisting of an outer annular body part 27 and an inner annular gland nut 28 which has a screw threaded connection to the body 27 so that it can be screwed between a lowered position shown on the right hand side of FIG. 1A, in which radial ducts 29 and 30, respectively in the body 27 and nut 28, are in communication with one another, and a raised position shown on the left hand side of FIG. 1A, in which the ducts are out of communication with one another. The duct 29 communicates through a conduit 31 between a depending portion of the body 27 and the housing 20, and through a conduit 32 passing through the production casing hanger 21, to the annulus surround the production casing. The duct 30 communicates through channels 33 formed in the radially inner surface of the nut 28, and hence to a void to be described. The cooperation between the gland nut 28 and body 27 of the adapter therefore acts as a valve which can open and close a passage up past the production casing hanger from the production casing annulus. After appropriate testing, a tool is run in through the BOP and, by means by radially projecting spring lugs engaging in the channels 33, rotates the gland nut 28 to the valve closed position shown on the right hand side on FIG. 1A. The well is thus resealed and the drilling BOP 22 can temporarily be removed.

Figure 2:
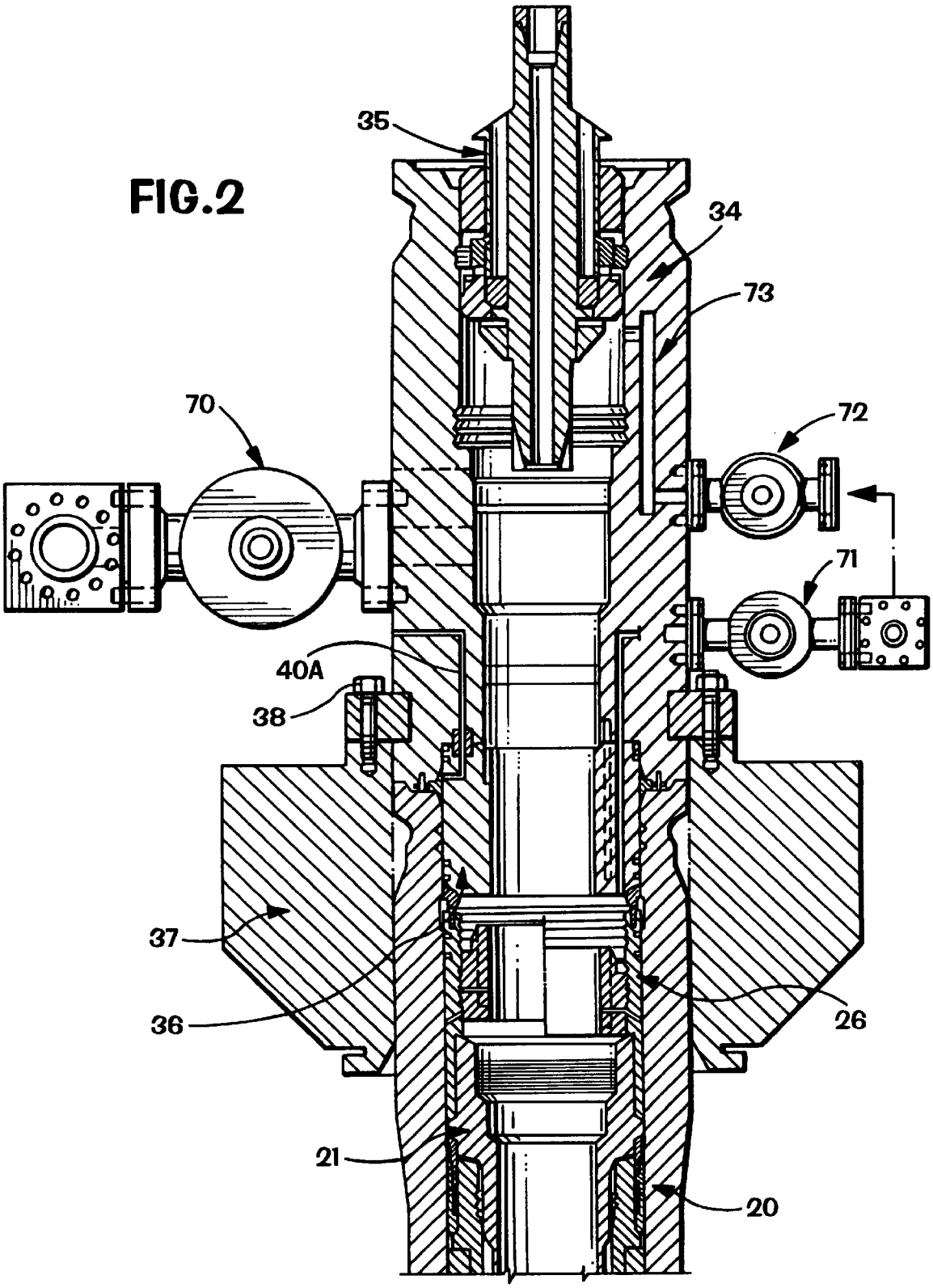
Figure 2A:
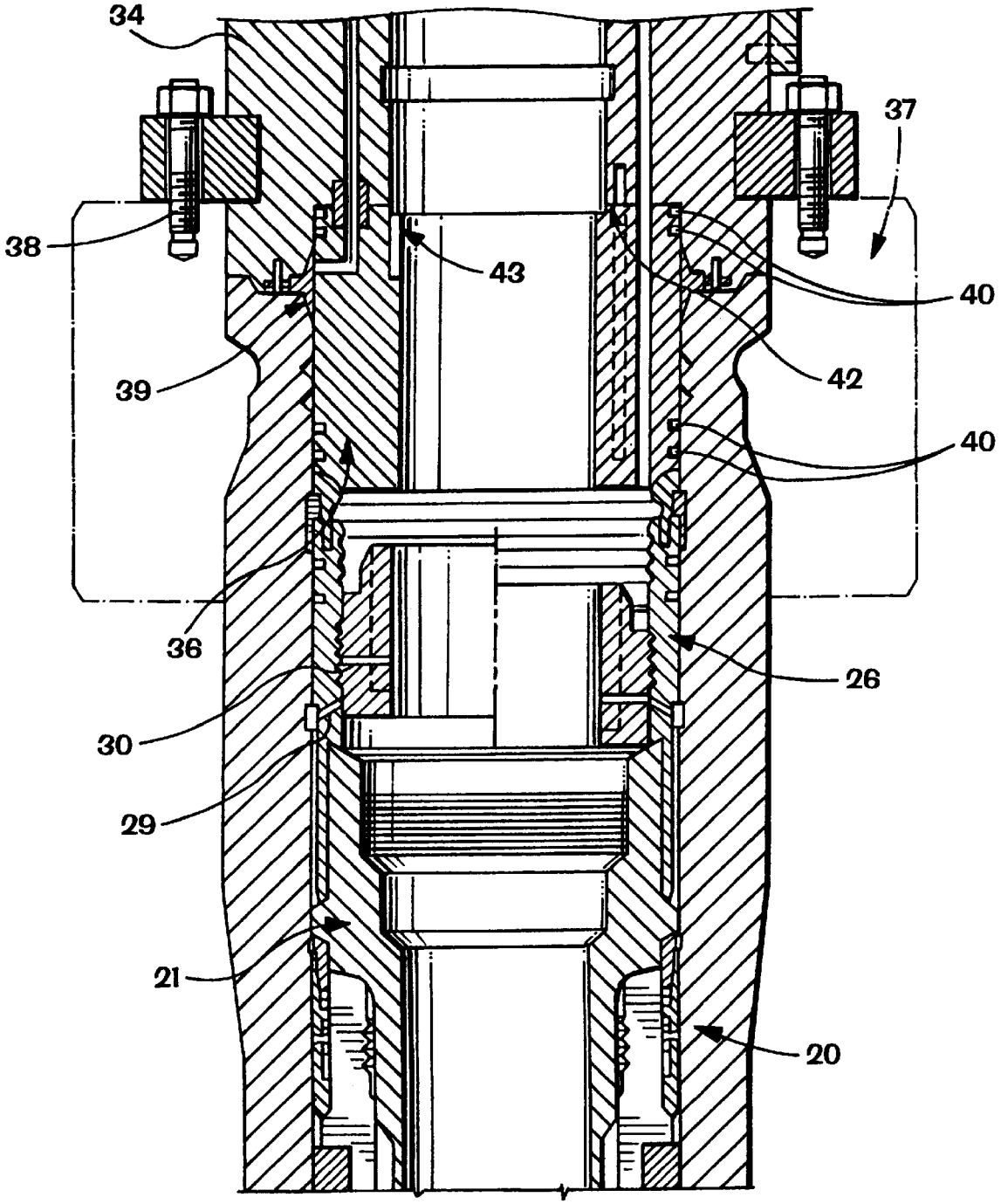

As shown in FIGS. 2 and 2A, the body of a tree spool 34 is then lowered on a tree installation tool 35, using conventional guide post location, or a guide funnel in case of deep water, until a spool tree mandrel 36 is guided into alignment with and slides as a close machined fit, into the upper end of the wellhead housing 20, to which the spool tree is then fixed via a production connector 37 and bolts 38. The mandrel 36 is actually a separate part which is bolted and sealed to the rest of the spool tree body. As seen particularly in FIG. 2A a weight set AX gasket 39, forming a metal to metal environmental seal is provided between the spool tree body and the wellhead housing 20. In addition two sets of sealing rings 40 provide, in series with the environmental seal, a production fluid seal externally between the ends to the spool tree mandrel 36 to the spool tree body and to the wellhead housing 20. The intervening cavity can be tested through a test ports 40A. The provision of the adapter 26 is actually optional, and in its absence the lower end of the spool tree mandrel 36 may form a production seal directly with the production casing hanger 21. As is also apparent from reasons which will subsequently become apparent, the upper radially inner edge of the spool tree mandrel projects radially inwardly from the inner surface of the spool tree body above, to form a landing shoulder 42 and at least one machined key slot 43 is formed down through the landing shoulder.

Figure 3:
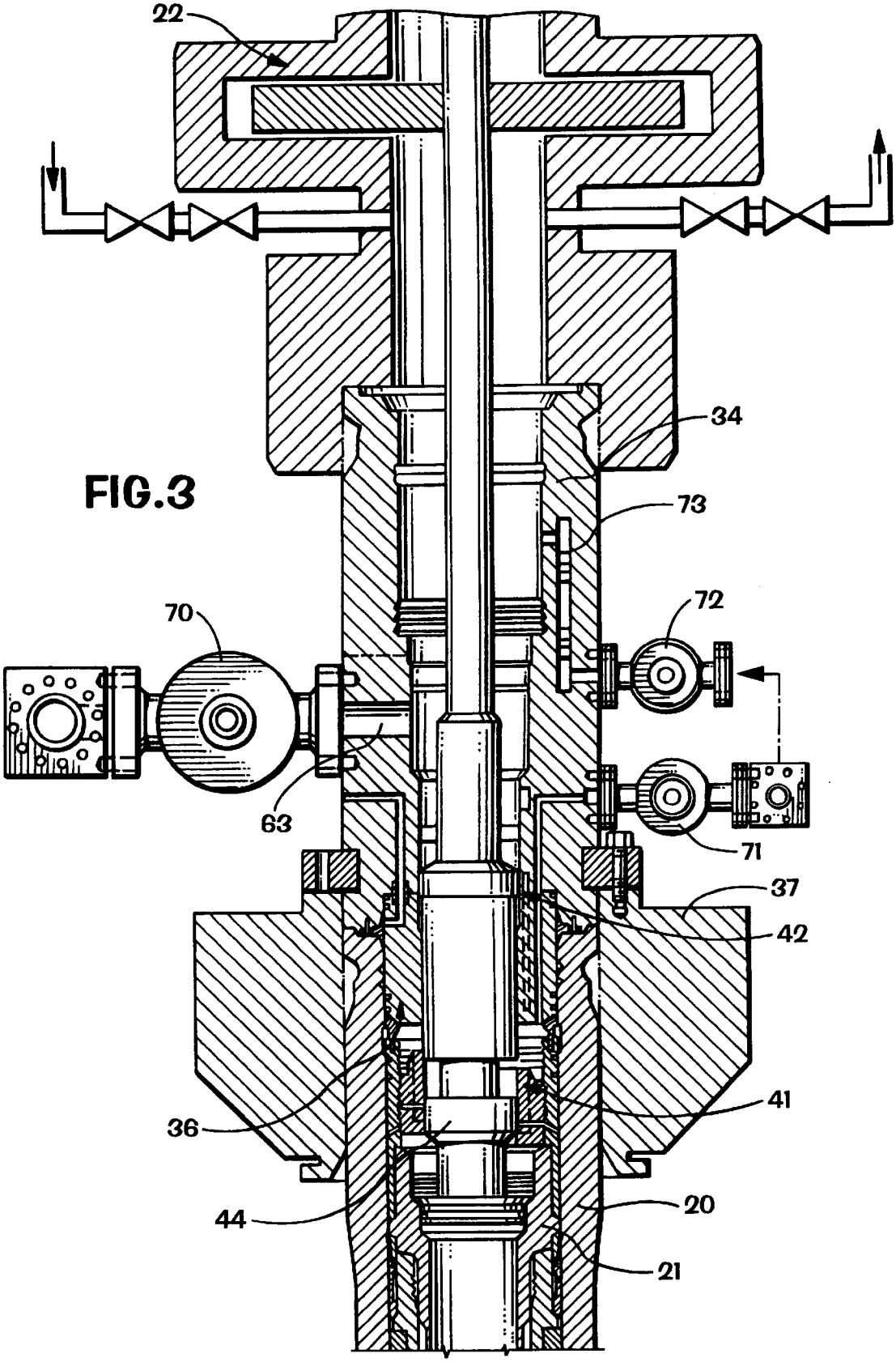

As shown in FIG. 3, the drilling BOP 22 is reinstalled on the spool tree 34. The tool 44 used to set the adapter in FIG. 1, having the spring dogs 41, is again run in until it lands on the shoulder 42, and the spring dogs 41 engage in the channels 33. The tool is then turned to screw the gland nut 28 down within the body 27 of the adapter 26 to the valve open position shown on the right hand side in FIG. 1A. It is now safe to open the production casing annulus as the well is protected by the BOP.

Figure 4:
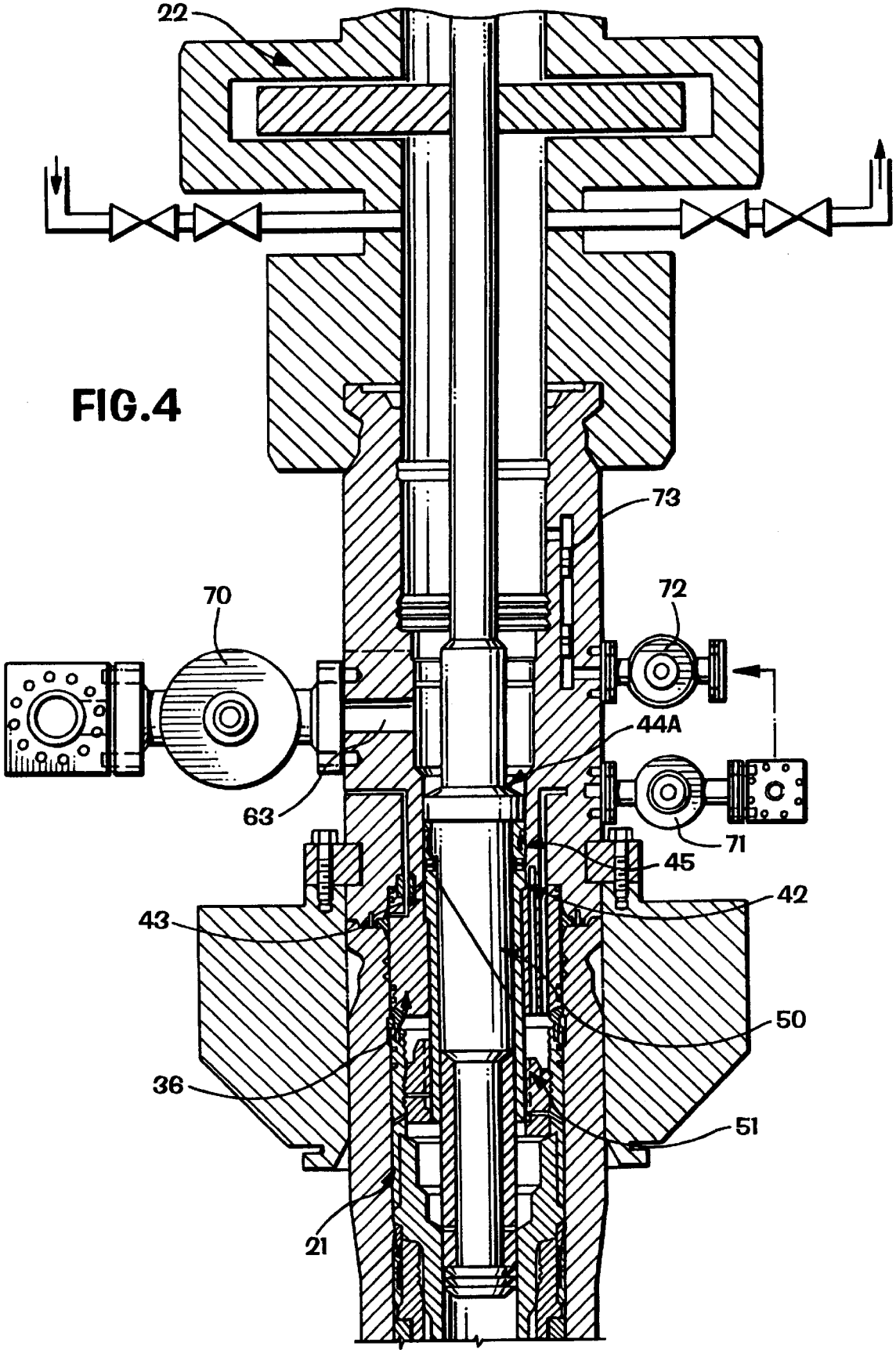
Figure 4A:
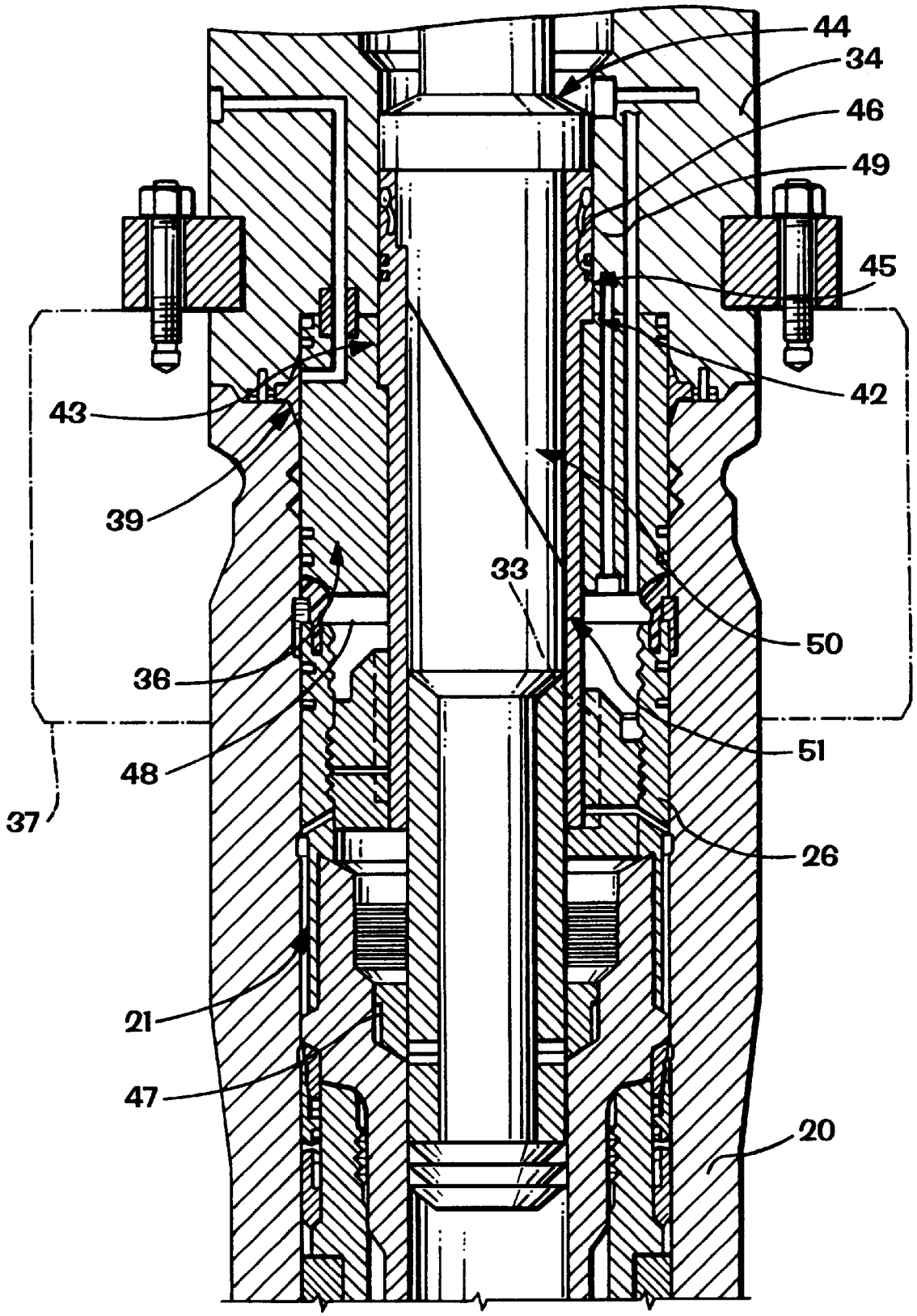

The next stage, shows in FIGS. 4 and 4A, is to run in through the BOP and spool tree on an appropriate tool 44A a combined isolation and orientation sleeve 45. This lands on the shoulder 42 at the top of the spool tree mandrel and is rotated until a key on the sleeve drops into the mandrel key slot 43. This ensures precise angular orientation between the sleeve 45 and the spool tree 44, which is necessary, and in contrast to the angular orientation between the spool tree 34 and the wellhead casing, which is arbitrary. The sleeve 45 consists of an external cylindrical portion, an upper external surface of which is sealed by ring seals 46 to the spool tree 34, and the lower external surface of which is sealed by an annular seal 47 to the production casing hanger 21. There is thus provided between the sleeve 45 and the surrounding wellhead casing 20 a void 48 with which the channels 33, now defined radially inwardly by the sleeve 45, communicate. The void 48 in turn communicates via a duct 49 through the mandrel and body of the spool tree 34 to a lateral port. It is thus possible to monitor and vent the pressure in the production casing annulus through the passage provided past the production casing hanger via the conduits 32, 31 the ducts 29 and 30, the channels 33, shown in FIG. 1A, the void 48, the duct 49, and the lateral port in the spool tree. In the drawings, the radial portion of the duct 49 is shown apparently communicating with a tubing annulus, but this is draughtsman's licence and the ports from the two annuli are, in fact, angularly and radially spaced.

Within the cylindrical portion of the sleeve 45 is a lining, which may be fixed in the cylindrical portion, or left after internal machining of the sleeve. This lining provides an orientation sleeve having an upper/edge forming a cam 50. The lowermost portion of the cam leads into a key slot 51.

Figure 5:
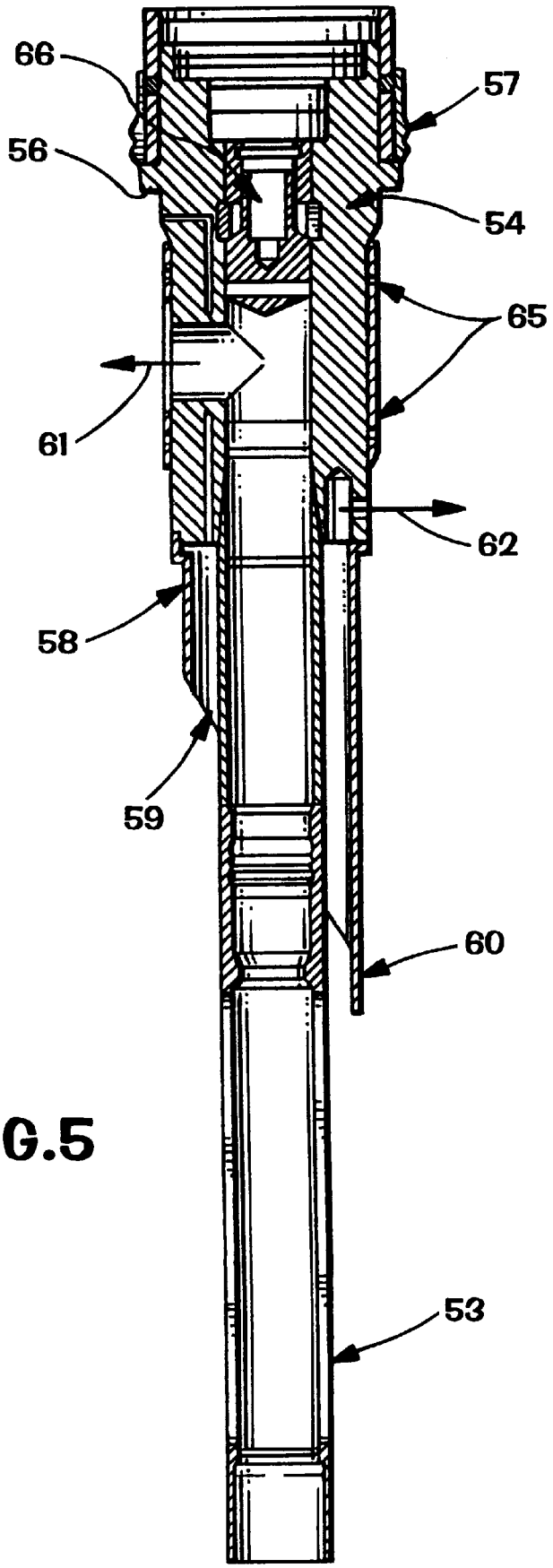
Figure 6:
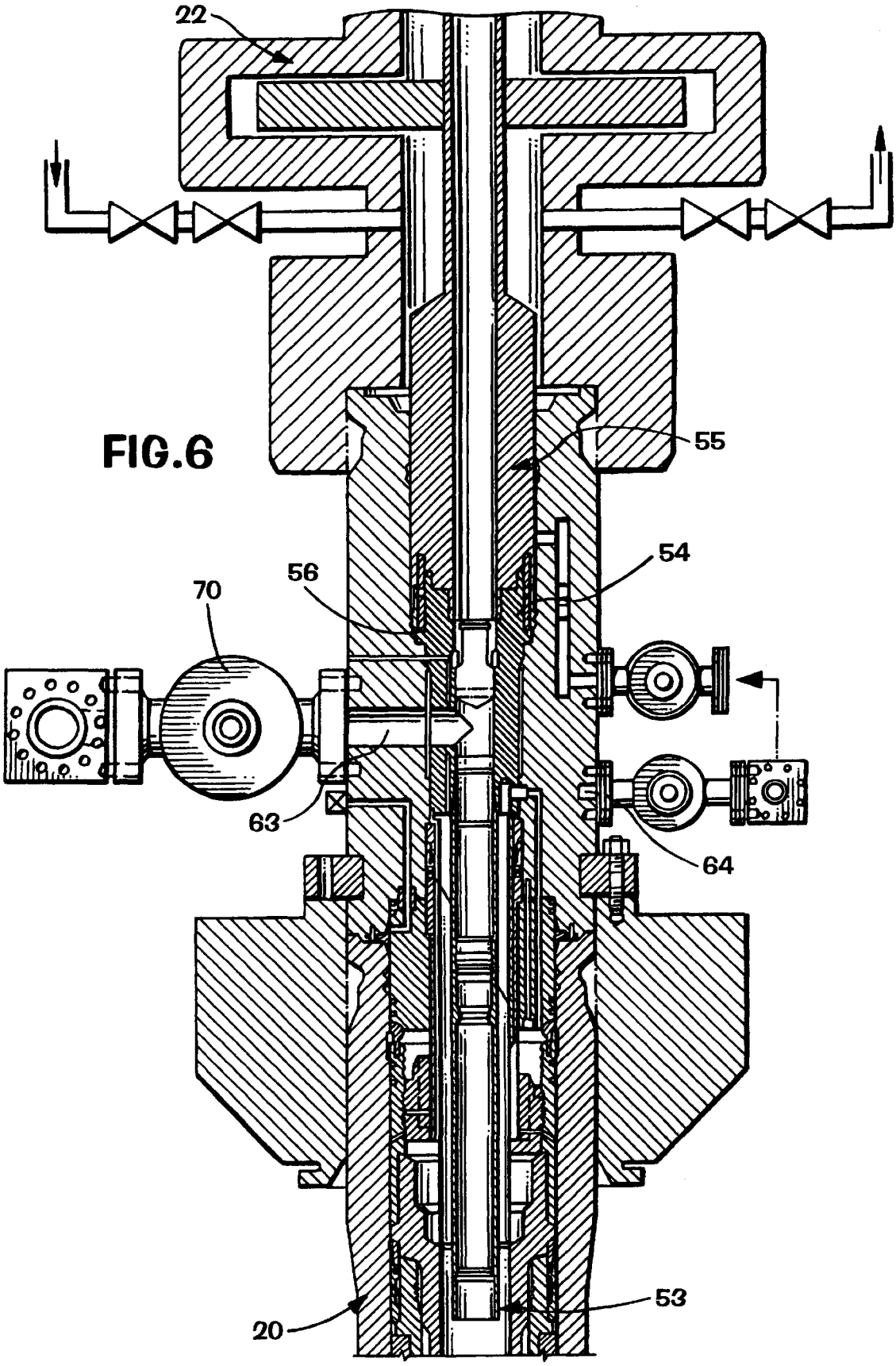
Figure 6A:
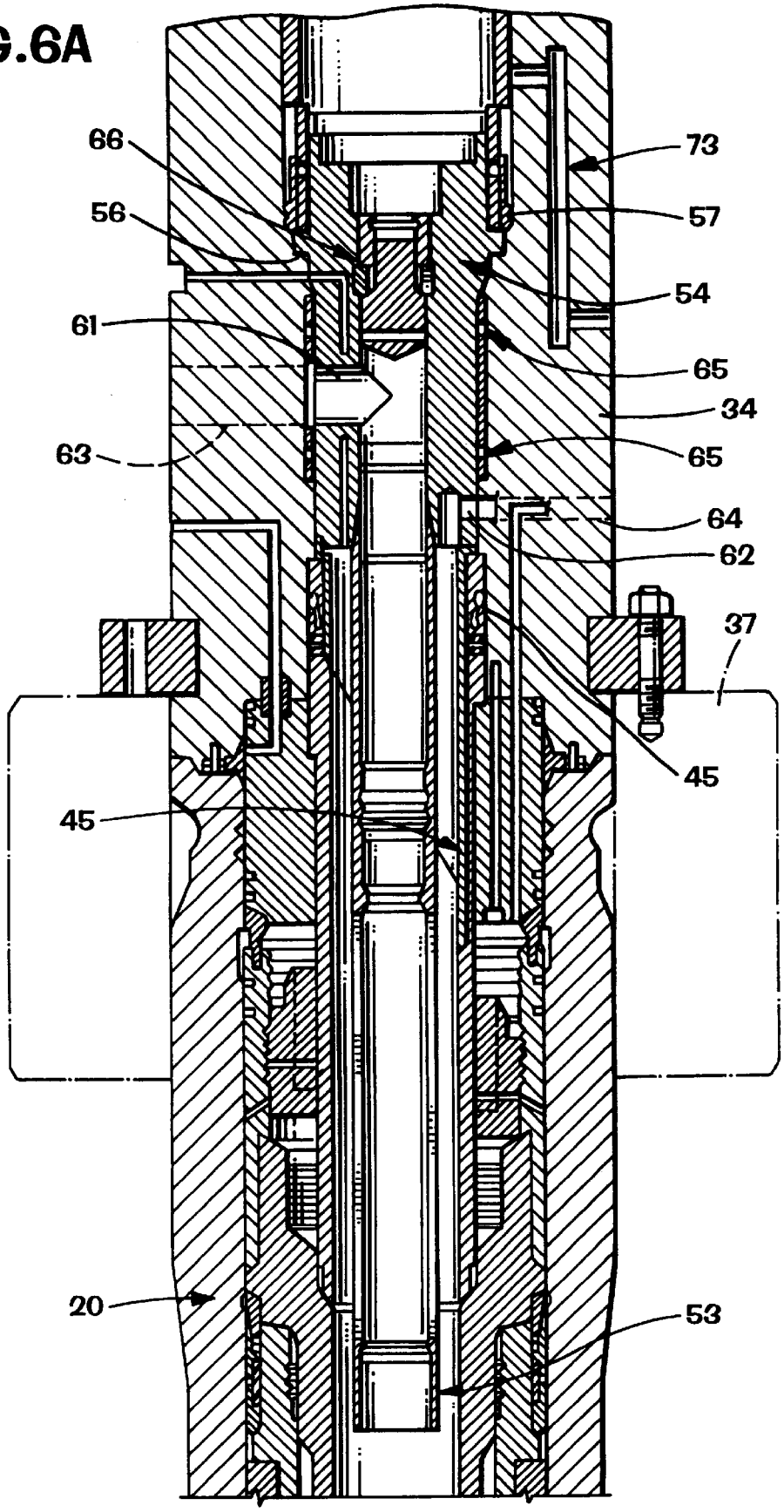

As shown in FIGS. 5,6 and 6A a tubing string of production tubing 53 on a tubing hanger 54 is run in through the BOP 22 and spool tree 34 on a tool 55 until the tubing hanger lands by means of a keyed shoulder 56 on a landing in the spool tree and is locked down by a conventional mechanism 57. The tubing hanger 54 has a depending orientation sleeve 58 having an oblique lower edge forming a cam 59 which is complementary to the cam 50 in the sleeve 45 and, at the lower end of the cam, a downwardly projecting key 60 which is complementary to the key slot 51. The effect of the cams 50 and 59 is that, irrespective of the angular orientation of the tubing string as it is run in, the cams will cause the tubing hanger 54 to be rotated to its correct angular orientation relatively to the spool tree and the engagement of the key 60 in the key slot 51 will lock this relative orientation between the tubing hanger and spool tree, so that lateral production and tubing annulus fluid flow ports 61 and 62 in the tubing hanger 54 are in alignment with respective lateral production and tubing annulus fluid flow ports 63 and 64 through the wall of the spool tree. Metal to metal annulus seals 65, which are set by the weight of the tubing string, provide production fluid seals between the tubing hanger 54 and the spool tree 34. Provision is made in the top of the tubing hanger 54 for a wireline set plug 66. The keyed shoulder 56 of the tubing hanger lands in a complementary machined step in the spool tree 34 to ensure ultimate machined accuracy of orientation between the tubing hanger 54 and the spool tree 34.

Figure 7:
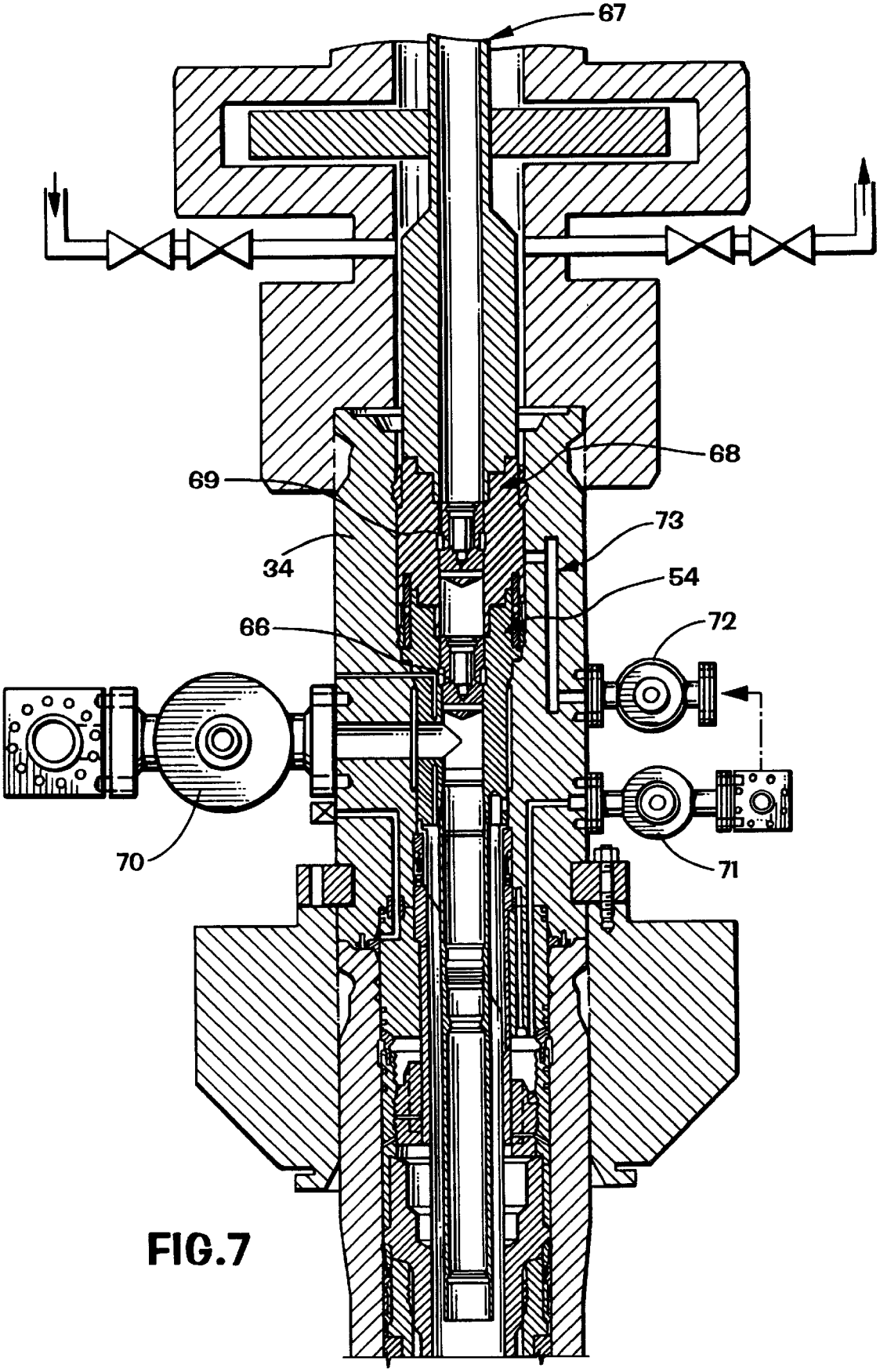

FIG. 7 shows the final step in the completion of the spool tree. This involves the running down on drill pipe 67 through the BOP, an internal isolation stopper 68 which seals within the top of the spool tree 34 and has an opening closed by an in situ wireline activated plug 69. The BOP can then be removed leaving the wellhead in production mode with double barrier isolation at the upper end of the spool tree provided by the plugs 66 and 69 and the stopper 68. The production fluid outlet is controlled by a master control valve 70 and pressure through the tubing annulus outlet ports 62 and 64 is controlled by an annulus master valve 71.

The other side of this valve is connected, through a workover valve 72 to a lateral workover port 73 which extends through the wall of the spool tree to the void between the plugs 69 and 66. With this arrangement, wireline access to the tubing annulus in and downstream of a tubing hanger is unnecessary as any circulation of fluids can take place through the valves 71 and 72, the ports 62, 64 and 73, and the kill or choke lines of any BOP which has been installed. The spool tree in the completed production mode is shown in FIG. 8.

Figure 9:
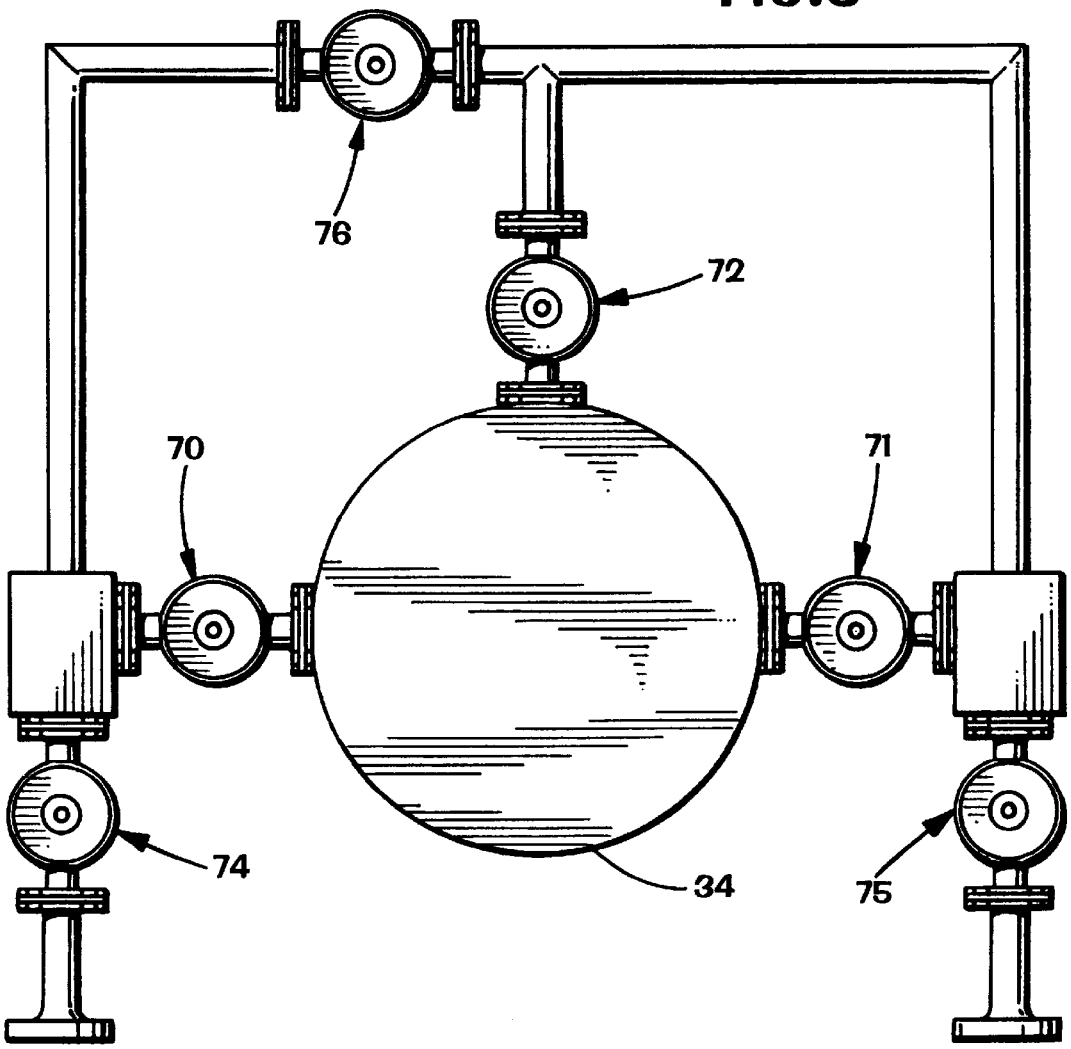
FIG. 9 is a circuit diagram showing external connections to the spool 3.

FIG. 9 shows valve circuitry associated with the completion and, in addition to the earlier views, shows a production fluid isolation valve 74, a tubing annulus valve 75 and a cross over valve 76. With this arrangement a wide variety of circulation can be achieved down hole using the production bore and tubing annulus, in conjunction with choke and kill lines extending from the BOP and through the usual riser string. All the valves are fail/safe closed if not actuated.

The arrangement shown in FIGS. 1 to 9 is a mono production bore wellhead which can be accessed by a single wireline or drill pipe, and the external loop from the tubing annulus port to the void between the two plugs at the top of the spool, tree avoids the need for wireline access to the tubing annulus bore.

Figure 8:
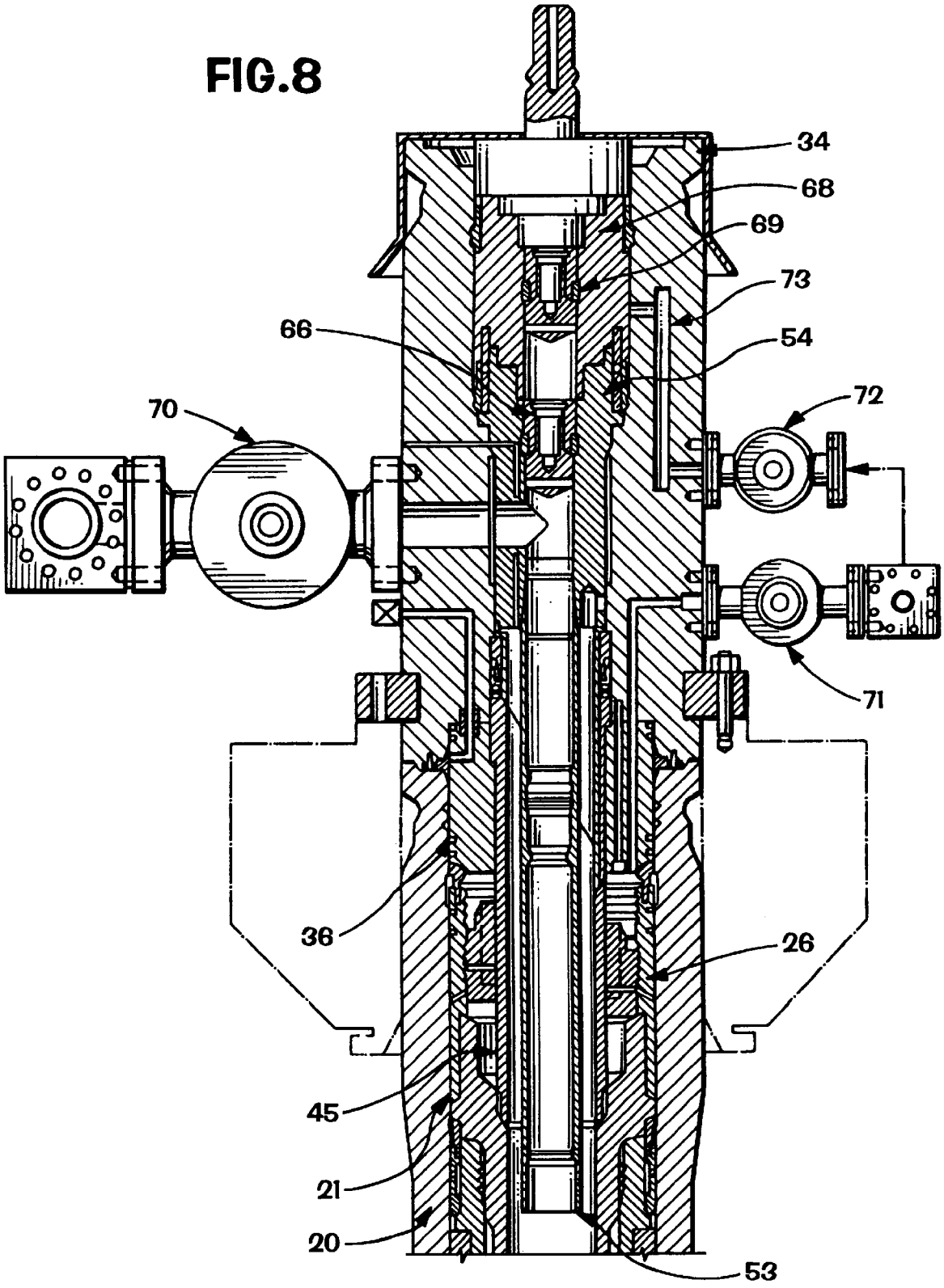
Figure 10:
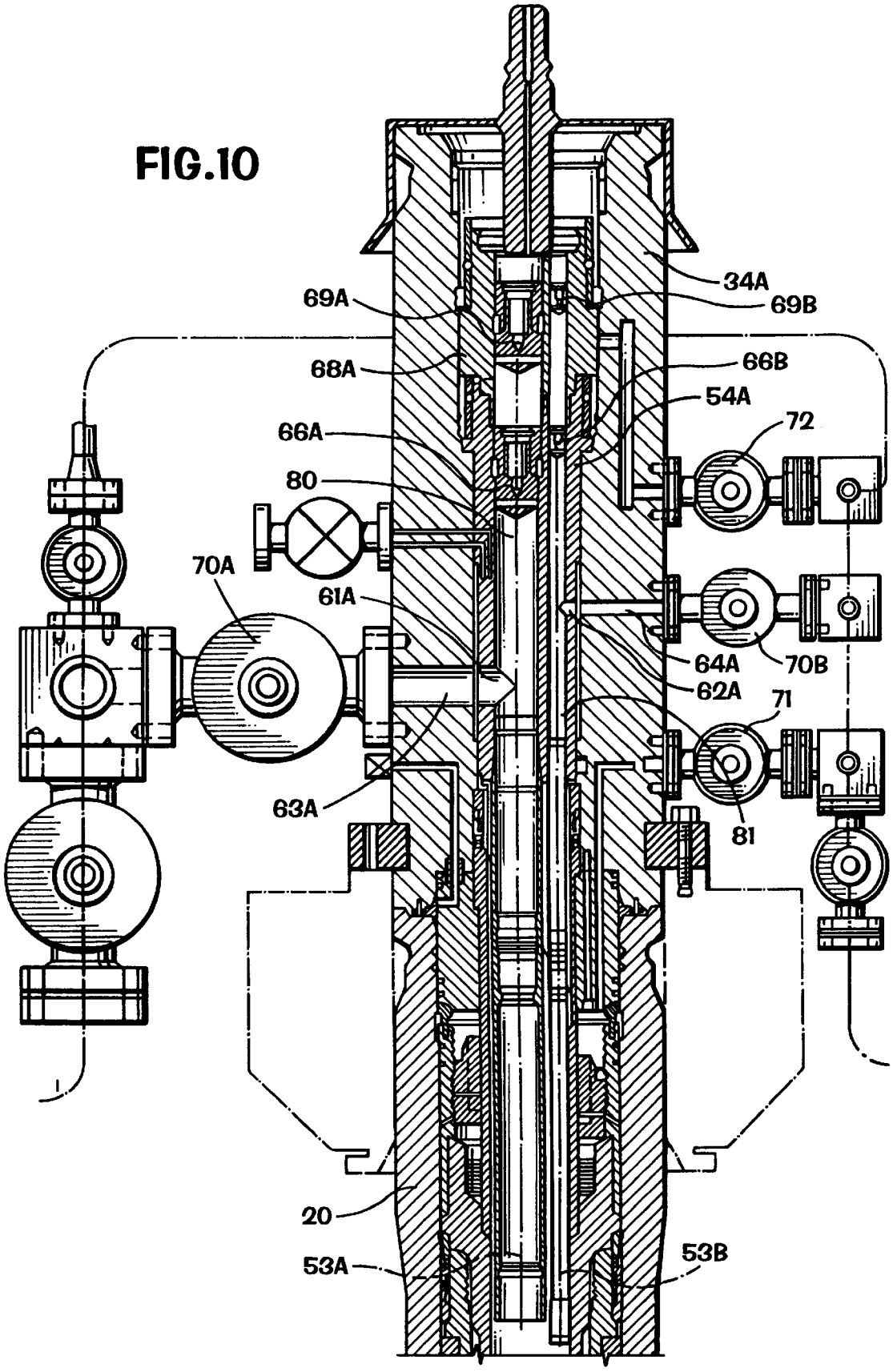
FIG. 10 is a vertical axial section through a completed dual production bore well in production mode.

FIG. 10 corresponds to FIG. 8 but shows a 5½ inch×2⅜ inch dual production bore wellhead with primary and secondary production tubing 53A and 53B. Development and completion are carried out as with the monobore wellhead except that the spool tree 34A and tubing hanger 54A are elongated to accommodate lateral outlet ports 61A, 63A for the primary production fluid flow from a primary bore 80 in the tubing hanger to a primary production master valve 70A, and lateral outlet ports 62A, 64A for the secondary production fluid flow from a secondary bore 81 in the tubing hanger to a secondary production master valve 70B. The upper ends of the bores 80 and 81 are closed by wireline plugs 66A and 66B. A stopper 68A, which closes the upper end of the spool tree 34A has openings, in alignment with the plugs 66A and 66B, closed by wireline plugs 69A and 69B.

Figure 13:
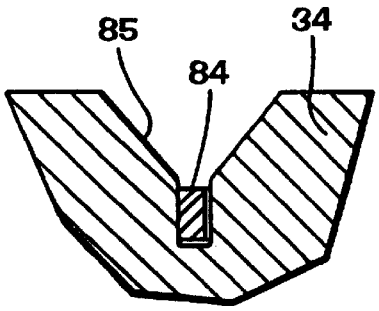
Figure 13A:
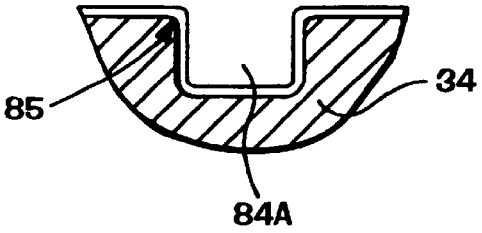
Figure 13B:
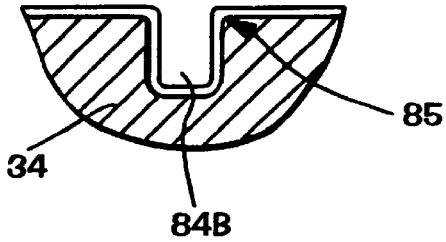
Figure 11:
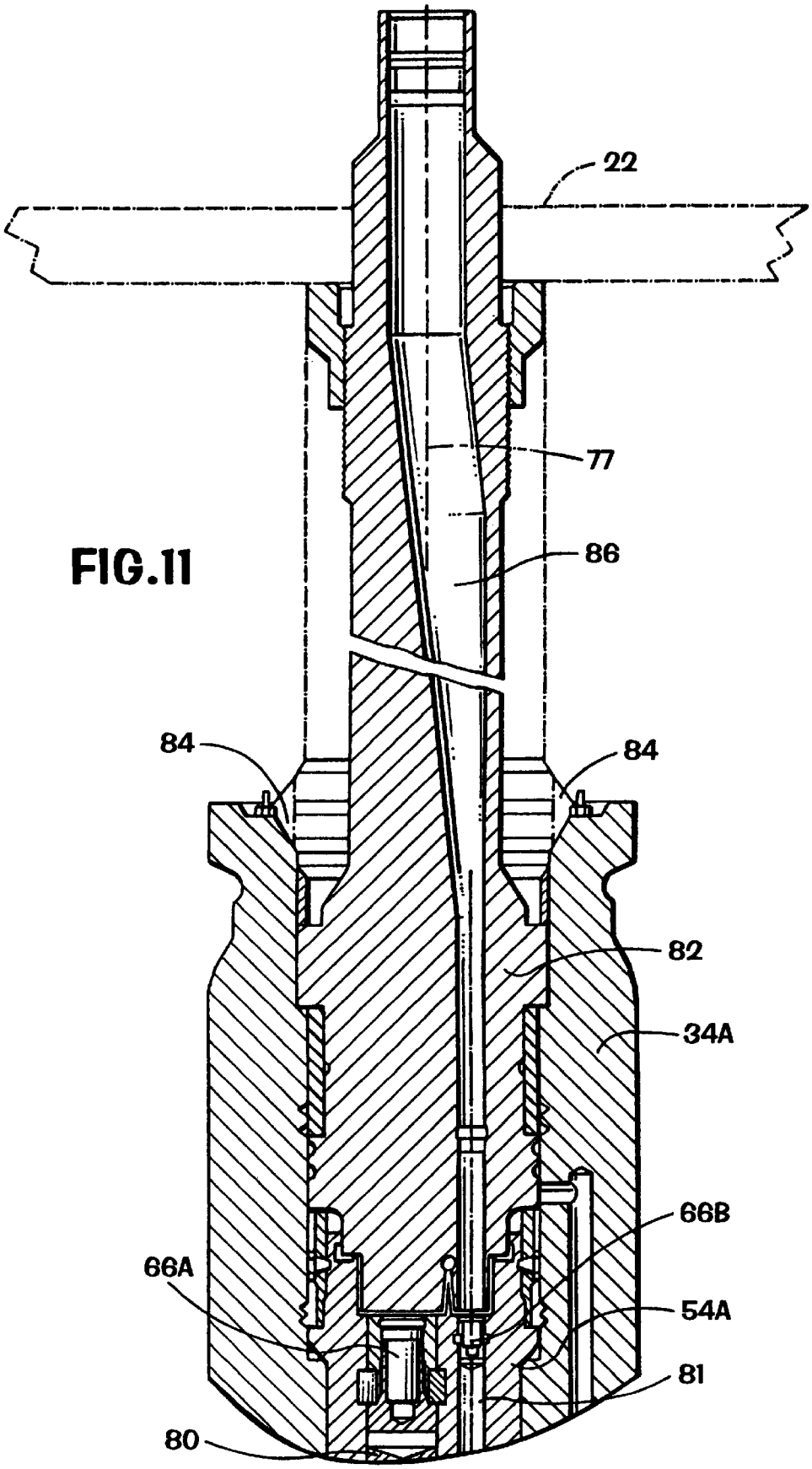
FIGS. 11 and 12 are vertical axial sections showing alternative connectors to the upper end of the dual production bore wellhead during work over; and, FIG. 13 is a detail showing the seating of one of the connectors in the spool tree.
Figure 12:
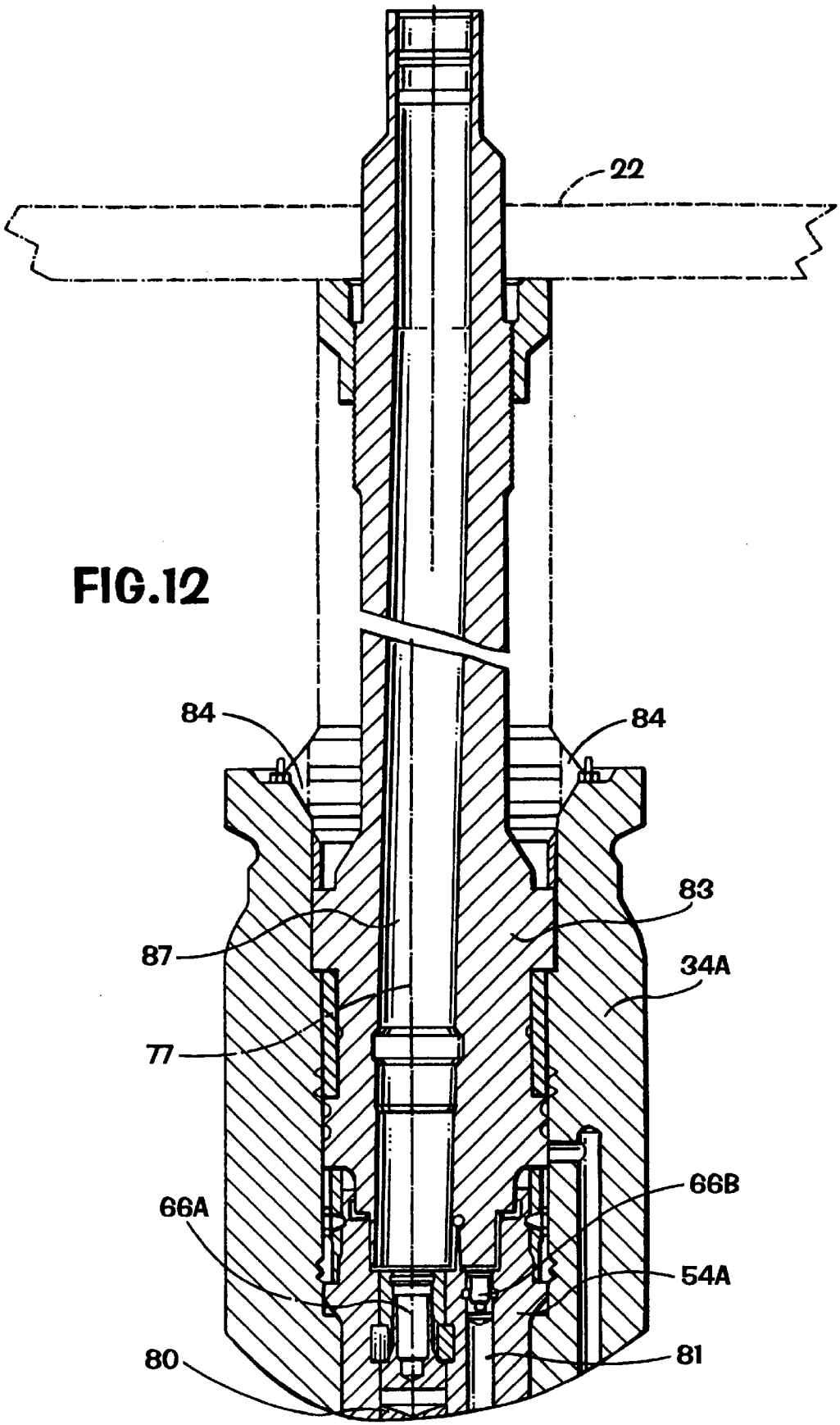

FIGS. 11 and 12 show how a wireline 77 can be applied through a single drill pipe to activate selectively one or other of the two wireline plugs 66A and 66B in the production bores 80 and 81 respectively. This involves the use of a selected one of two connectors 82 and 83. In practice, a drilling BOP 22 is installed and the stopper 68A is removed. Thereafter the connector 82 or 83 is run in on the drill pipe or tubing until it lands in, and is secured and sealed to the spool tree 34A. FIG. 13 shows how the correct angular orientation between the connector 82 or 83 and the spool tree 34A, is achieved by wing keys 84, which are guided by Y-shaped slots 85 in the upper inner edge of the spool tree, first to bring the connectors into the right angular orientation, and then to allow the relative axial movement between the parts to enable the stabbing function when the wireline connector engages with its respective pockets above plug 66A or 66B. To ensure equal landing forces and concentricity on initial contact, two keys 84A and 84B are recommended. As the running tool is slowly rotated under a new control weight, it is essential that the tool only enters in one fixed orientation. To ensure this key 84A is wider than key 84B and its respective Y-shaped slots. It will be seen that one of the connectors 82 has a guide duct 86 which leads the wireline to the plug 66B whereas the other connector 83 has a similar guide duct 87 which leads the wireline to the other plug 66A.

We claim:

1. A wellhead assembly for supporting tubing within a well for selective use with a blowout preventer having a BOP bore comprising:

a housing;

a spool tree adapted for disposal below the blowout preventer and fixed and sealed to said housing, said spool tree having a wall with a central bore therethrough and a first lateral port connected to a valve, said central bore having an internal surface and adapted to form a common passageway with the BOP bore;

a tubing hanger landed and sealed within said spool tree at a predetermined angular position at which a second lateral port in said tubing hanger is in alignment with said first lateral port in said spool tree, said tubing hanger supporting the tubing;

at least one vertical bore in said tubing hanger being sealed above said second lateral port by a first closure member, and said internal surface of said central bore through said spool tree being sealed above said tubing hanger by a second closure member, said closure members being retrievable through the BOP bore;

a workover port extending through said wall of said spool tree for selective fluid circulation with that portion of said common passageway below the BOP bore and above said tubing hanger; and an annulus port extending through said wall of said spool tree for selective fluid circulation with an annulus around the tubing, said workover and annulus ports being interconnected via a flow passageway having at least one valve.

2. The wellhead assembly of claim 1 further comprising a bypass flowpath extending from said annulus port, through said flow passageway and said workover port, to said central bore above said tubing hanger.

3. The wellhead assembly of claim 1, further comprising a crossover flowpath interconnecting said first lateral port and said flow passageway, said crossover flowpath having a crossover valve for controlling flow therethrough.

4. The wellhead assembly of claim 3 further comprising a first combined workover flowpath extending from said annulus port, through said flow passageway and said crossover flowpath, to said first lateral port.

5. The wellhead assembly of claim 3 further comprising a second combined workover flowpath extending from said workover port, through said flow passageway and said crossover flowpath, to said first lateral port.

6. The wellhead assembly of claim 1 wherein said central bore has an inside diameter substantially the same as the diameter of the BOP bore.

7. An apparatus for use selectively with a blowout preventer for controlling the flow of fluids in a well comprising:

a production member adapted for disposal below the blowout preventer, said production member having a central bore formed by a wall of said production member and a production passageway, an annulus passageway, and a workover passageway in said wall, said workover passageway extending laterally into said central bore;

a production valve disposed with said production member for controlling flow through said production passageway;

an annulus valve disposed with said production member for selective fluid circulation downhole through said annulus passageway;

a workover valve disposed with said production member for selective fluid circulation through said workover passageway;

a tubing hanger supported and sealed within said production member and suspending tubing in the well, said tubing hanger and tubing having a flowbore and forming an annulus in the well, said tubing hanger having an aperture communicating said flowbore with said production passageway, and said annulus passageway communicating with said annulus;

said workover passageway in fluid communication with said production member central bore above said tubing hanger;

said annulus passageway in fluid communication with said workover passageway;

said production passageway in fluid communication with said annulus passageway and workover passageway;

a crossover valve for controlling fluid flow between said production passageway and said annulus passageway or workover passageway; and fluid circulation paths being formed between said production member central bore, workover passageway, and annulus passageway to selectively circulate downhole using said tubing flowbore and tubing annulus.

8. The apparatus of claim 7 further including a production fluid isolation valve communicating with said production passageway and an annulus isolation valve communicating with said annulus passageway.

9. A method for controlling fluid flow in a well comprising:

suspending tubing from a tubing hanger;

supporting and sealing the tubing hanger within the bore of a production member for selective disposal below a blowout preventer having a BOP bore;

forming a common flow passageway between the BOP bore and a portion of the production member bore above the seals around the tubing hanger;

extending a tubular member into the BOP bore, attaching the tubular member to the tubing hanger, and closing the blowout preventer therearound;

forming a flowpath through the tubing and the tubular member, forming an annular area between the tubular member and the production member in the common flow passageway and forming an annulus around the tubing below the tubing hanger;

forming a production passageway from the flowpath, through a lateral port in the tubing hanger and through the wall of the production member;

controlling flow through the production passageway by a production valve;

forming an annulus passageway from the annulus and through the wall of the production member;

controlling flow through the annulus passageway by an annulus valve;

forming a workover passageway from the annular area and through the wall of the production member;

controlling flow through the workover passageway;

providing fluid communication between the workover passageway and the annulus passageway;

forming a crossover fluid passageway between the production passageway and annulus passageway;

controlling flow through the crossover fluid passageway; and circulating fluid downhole using the flowpath, tubing annulus, annulus passageway, workover passageway, and annular area.

10. The method of claim 9 further including flowing fluid downhole through the workover passageway, the crossover passageway, and the production passageway.

11. A method for controlling fluid flow in a well comprising:

suspending tubing from a tubing hanger;

supporting and sealing the tubing hanger within the bore of a production member for selective disposal below a blowout preventer having a BOP bore;

forming a common flow passageway between the BOP bore and a portion of the production member bore above the tubing hanger;

extending a tubular member into the BOP bore, attaching and sealing the tubular member to the tubing hanger, and closing the blowout preventer therearound with the tubular member in fluid communication with said tubing flowbore;

forming a flowbore through the tubing, an annulus around the tubing below the tubing hanger, and an annular area between the tubular member and production member in the common flow passageway;

forming a production passageway from the flowbore, through a lateral port in the tubing hanger and through the wall of theproducfion member;

controlling flow through the production passageway by a production valve;

forming an annulus passageway from the annulus and through the wall of the production member;

controlling flow through the annulus passageway by an annulus valve;

forming a workover passageway communicating with the annular area through the wall of the production member;

controlling flow through the workover passageway;

providing fluid communication between the workover passageway and annulus passageway;

forming a crossover fluid passageway between the production passageway and annulus passageway;

controlling flow through the crossover fluid passageway;

installing a tubing hanger closure member in the tubing hanger above the production passageway;

removing the tubular member; and flowing fluid through the production passageway, through the crossover passageway and into the annulus passageway.

12. A method for controlling fluid flow in a well comprising:

suspending tubing from a tubing hanger;

supporting and sealing the tubing hanger within the bore of a production member for selective disposal below a blowout preventer having a BOP bore;

forming a common flow passageway between the BOP bore and a portion of the production member bore above the tubing hanger;

forming a flowbore through the tubing and an annulus around the tubing below the tubing hanger;

forming a production passageway from the flowbore, through a lateral port in the tubing hanger and through the wall of the production member;

controlling flow through the production passageway by a production valve;

forming an annulus passageway from the annulus and through the wall of the production member;

controlling flow through the annulus passageway by an annulus valve;

installing a tubing hanger closure member in the tubing hanger above the production passageway;

installing an internal closure member within the portion of the production member bore above the tubing hanger;

forming a workover passageway through the wall of the production member from the bore of the production member above the tubing hanger and between the tubing hanger closure member and internal closure member;

controlling flow through the workover passageway;

forming a crossover fluid passageway between the production passageway and annulus passageway;

controlling flow through the crossover fluid passageway;

providing fluid communication between the workover passageway and the crossover fluid passageway; and flowing fluid through the production passageway, through the crossover passageway and into the workover passageway between the tubing hanger closure member and the internal closure member.

13. An assembly for producing a well comprising:

a wellhead supporting a casing hanger that suspends casing which forms a casing annulus;

a pressure monitoring valve disposed within said wellhead on said casing hanger and connected to a passageway extending to the casing annulus for monitoring the pressure in the casing annulus;

a spool tree mandrel projecting into said wellhead and disposed on said pressure monitoring valve;

a completion tree connected to said wellhead;

a drilling blowout preventer connected to said completion tree;

said wellhead, completion tree and blowout preventer forming a common bore;

said completion tree having a master horizontal bore, an annulus horizontal bore, and a workover bore;

a production master valve connected to said master horizontal bore;

an annulus master valve connected to said annulus horizontal bore;

a workover valve connected to said workover bore;

a pressure monitoring port extending through said completion tree and spool tree mandrel and communicating with an annular space above said pressure monitoring valve;

an orientation sleeve associated with said spool tree mandrel and having an orienting cam surface;

a tubing hanger lowerable through said common bore and having a side master port and a side annulus port, said tubing hanger having an orienting cam member engaging said orienting cam surface to align said side master and annulus ports with said master and annulus horizontal bores in said completion tree;

said tubing hanger suspending tubing within said casing and forming a tubing annulus;

a tubing hanger plug disposed in said tubing hanger for plugging said tubing hanger above said side master port;

an isolation member mounted at least partially within said completion tree above said tubing hanger and having a central bore;

an isolation plug disposed within said isolation member for plugging said central bore;

a cover disposed on said isolation member and covering said common bore; and said workover bore communicating with said common bore between said tubing hanger plug and said isolation plug.

14. A spool tree assembly for use selectively with a blowout preventer for operating a subsea well, comprising:

a spool body adapted for disposal below the blowout preventer and having a central bore therethrough, a portion of said central bore being formed by an internal generally vertical wall surface, said internal generally vertical wall surface having an opening therein;

a tubing hanger assembly mounted and sealed in a predetermined angular position within said central bore of said spool body and suspending tubing within the well, said tubing hanger assembly and tubing forming a central passageway therethrough and an annulus around the tubing below the tubing hanger;

said spool body and said tubing hanger assembly having a production passageway extending from said central passageway of said tubing hanger assembly into said wall of said spool body;

said spool body and said tubing hanger assembly having an annulus passageway extending from said annulus around the tubing below the tubing hanger and into said wall of said spool body;

said spool body having a workover passageway extending from said opening in said central bore and into said spool body wall, said opening in fluid communication with said central bore above the tubing hanger; and said annulus passageway and workover passageway being in fluid communication through a flowpath to selectively circulate downhole from said central bore of said spool body through said workover passageway and annulus passageway with flow through said tubing hanger assembly annulus and central passageway of said tubing hanger assembly.

15. The spool tree assembly of claim 14 further comprising a closure member sealingly disposed within said central bore of said spool body to control flow through said central bore.

16. A spool tree assembly for use selectively with a blowout preventer having a BOP bore for operating a subsea well, comprising:

a spool body adapted for disposal below the blowout preventer and having a generally cylindrical wall forming a central bore therethrough, a portion of said central bore being adapted to form a flow passageway with the BOP bore;

a tubing hanger assembly mounted and sealed within said central bore of said spool body and suspending tubing within the well said tubing hanger and tubing forming a central passageway in fluid communication with said central bore of said spool body above said tubing hanger assembly and forming an annulus around the tubing below the tubing hanger;

said spool body and said tubing hanger assembly having a production passageway extending from said central passageway of said tubing hanger assembly into said wall of said spool body;

said spool body and said tubing hanger assembly having an annulus passageway extending from said annulus around the tubing below the tubing hanger and into said wall of said spool body;

said spool body having a workover passageway extending from said portion of said central bore of said spool body and into said spool body wall for fluid communication with said portion of said spool body central bore above said tubing hanger;

said annulus passageway and workover passageway being in fluid communication through a flowpath outside of said central bore of said spool body;

a first closure member mounted within said central passageway of said tubing hanger assembly to control flow through said central passageway and through said central bore of said spool body; and a second closure member sealed and locked internally of said portion of said central bore above said tubing hanger assembly.

17. The spool tree assembly of claim 16 wherein said workover passageway is in fluid communication with said portion of said central bore between said first and second closure members.

18. A wellhead for supporting tubing for use selectively with a blowout preventer having a BOP bore comprising:

a wellhead housing;

a spool tree adapted for disposal below the blowout preventer and fixed and sealed to said housing, said spool tree having a wall with a central bore therethrough and at least a first lateral production fluid outlet port connected to a valve, a portion of said central bore being adapted to form a common passageway with the BOP bore;

a tubing hanger supporting the tubing and landed and sealed within said spool tree at a predetermined angular position at which a second lateral production fluid outlet port in said tubing hanger is in alignment with said first lateral production fluid outlet port in said spool tree;

at least one vertical production fluid bore in said tubing hanger being sealed above said second lateral production fluid outlet port by a first removable closure member, and said portion of said central bore through said spool tree being internally sealed above said tubing hanger by a second closure member removable through the BOP bore;

a workover port extending at least partially through said wall of said spool tree from an area in said portion of said central bore between said two closure members; and a tubing annulus fluid port extending at least partially through said wall of said spool tree from an annulus formed around the tubing; said workover and tubing annulus ports in said spool tree being interconnected via a passageway having at least one valve.

19. A spool tree system for use selectively with a blowout preventer having a BOP bore for a subsea well, comprising:

a spool tree having a bore therethrough, a portion of said bore being adapted to form a flow passageway with the BOP bore upon installing the blowout preventer above said spool tree;

a tubing hanger suspending tubing and supported by said spool tree, seals sealing between said tubing hanger and said spool tree, said tubing hanger and tubing having an internal production bore extending downwardly into the well and forming a tubing annulus extending downwardly into the well;

said spool tree and tubing hanger forming a lateral production flowpath in fluid communication with said internal production bore and having a production control valve for opening and closing said lateral production flowpath to control flow therethrough;

said spool tree forming an annulus flowpath in fluid communication with said tubing annulus and having an annulus control valve controlling flow therethrough;

said spool tree having a workover flowpath through the wall of the spool tree communicating with said portion of said spool tree bore above said seals and having a workover valve controlling flow therethrough;

a circulation flowpath being formed through said internal production bore of said tubing hanger with said lateral production flowpath closed and through said tubing annulus to selectively circulate fluid downhole using said internal production bore and said tubing annulus; and said internal production bore above said lateral production flowpath being adapted for isolation from said spool tree bore portion.

20. The spool tree system of claim 19, further comprising:

a first closure member mounted in said tubing hanger; and, a second closure member sealably mounted completely internal of said portion of said bore of said spool tree.

21. The spool tree system of claim 20, wherein a fluid passageway is formed above said first closure member for selective fluid circulation.

22. The spool tree system of claim 20 wherein said workover flowpath terminates in said portion of said spool tree bore between said first and second closure members.

23. The spool tree system of claim 19, further including a first external flowpath with a tubing annulus valve for controlling flow therethrough, a second extena flowpath with a production fluid isolation valve for controlling flow therethrough, and a fluid passageway formed between said first and second external flowpaths by said annulus flowpath, tubing annulus, production bore, and production flowpath.

24. A spool tree system for use selectively with a blowout preventer having a BOP bore, a tubular member extending through the BOP bore and having a fluid bore, and a wellhead for a subsea well, comprising:

a spool tree for installation on the wellhead, said spool tree having a wall with a bore therethrough, a portion of said bore being adapted to form a flow passageway with the BOP bore upon installation of the blowout preventer above said spool tree;

a tubing hanger suspending tubing and supported by said spool tree, seals sealing between said tubing hanger and said spool tree, said tubing hanger and tubing having an internal production bore and forming a tubing annulus extending downwardly into the well, said internal production bore adapted for connection with the tubular member for fluid communication with the fluid bore of the tubular member;

said spool tree and tubing hanger forming a lateral production flowpath in fluid communication with said internal production bore and having a production control valve controlling flow therethrough;

said spool tree forming an annulus flowpath in fluid communication with said tubing annulus and having an annulus control valve controlling flow therethrough;

said spool tree having a workover flowpath through the wall of the spool tree communicating with said portion of said spool tree bore above said seals and having a workover valve controlling flow therethrough;

a circulation flowpath being formed upon establishing fluid communication between said internal production bore of said tubing hanger and tubing and fluid bore of said tubular member, said circulation flowpath allowing flow through said internal production bore of said tubing hanger and tubing and fluid bore of said tubular member and through said annulus and annulus flowpath for selective fluid circulation through said circulation flowpath;

a workover/annulus flow connection interconnecting said workover flowpath and said annulus flowpath for selective fluid circulation downhole through said circulation flowpath and said workover flowpath to an annular area formed between the tubular member and spool tree bore.

25. The spool tree system of claim 24 further comprising a bypass flowpath extending from said annulus flowpath, through said workover/annulus flow connection and said workover flowpath, to said portion of said spool tree bore.

26. The spool tree system of claim 24, further comprising a crossover flowpath interconnecting said production flowpath and said workover/annulus flow connection, said crossover flowpath having a crossover valve for controlling flow therethrough.

27. The spool tree system of claim 26 further comprising a first combined workover flowpath extending from said annulus flowpath, through said workover/annulus flow connection and said crossover flowpath, to said production flowpath.

28. The spool tree system of claim 26 further comprising a second combined workover flowpath extending from said workover flowpath, through said workover/annulus flow connection and said crossover flowpath, to said production flowpath.

29. A spool tree system for a wellhead for the completion and work-over of a subsea well, comprising:

a spool tree having a bore and for installation on the wellhead;

a tubing hanger suspending tubing and supported by said spool tree, seals sealing between said tubing hanger and said spool tree, said tubing having an internal production bore and forming a tubing annulus extending downwardly into the well;

said spool tree and tubing hanger forming a production flowpath in fluid communication with said internal production bore and having a production control valve controlling flow therethrough;

said spool tree forming an annulus flowpath in fluid communication with said tubing annulus and having an annulus control valve controlling flow therethrough;

a drilling blowout preventer having a BOP bore and a member for closing said BOP bore, a portion of said spool tree bore adapted to form a flow passageway with said BOP bore;

said spool tree having a workover flowpath communicating with said spool tree bore portion above said seals and below said BOP bore and having a workover valve controlling flow therethrough;

choke and kill lines connected to said drilling blowout preventer for communicating said BOP bore with the surface; and a tubular member extending to the surface and in fluid communication with said tubing hanger, said tubular member forming a common bore communicating with said internal production bore for selective fluid circulation downhole using said internal production bore and tubing annulus in conjunction with at least one of said choke and kill lines extending from the BOP to the surface.

30. The spool tree system of claim 29, wherein one of said choke and kill lines forms a passageway from the surface to said BOP bore above said tubing hanger.

31. The spool tree system of claim 29 further comprising a workover/annulus flow connection interconnecting said workover flowpath and said annulus flowpath for selective fluid communication.

32. The spool tree system of claim 31, further comprising a crossover flowpath interconnecting production flowpath and said workover/annulus flow connection, said crossover flowpath having a crossover valve for controlling flow therethrough.

33. A spool tree system for a wellhead for the completion and work-over of a subsea well, comprising:

a spool tree having a bore and for installation on the wellhead;

a tubing hanger suspending tubing and supported by said spool tree, seals sealing between said tubing hanger and said spool tree, said tubing having an internal production bore and forming a tubing annulus extending downwardly into the well;

said spool tree and tubing hanger forming a production flowpath in fluid communication with said internal production bore and having a production control valve controlling flow therethrough;

said spool tree forming an annulus flowpath in fluid communication with said tubing annulus and having an annulus control valve controlling flow therethrough;

a drilling blowout preventer having a BOP bore and a member for closing said BOP bore, a portion of said spool tree bore adapted to form a flow passageway with said BOP bore;

said spool tree having a workover flowpath communicating with said spool tree bore portion above said seals and below said BOP bore and having a workover valve controlling flow therethrough;

choke and kill lines connected to said drilling blowout preventer for communicating said BOP bore with the surface;

a pipe string extending to the surface and in fluid communication with said tubing hanger, said pipe string forming a common bore communicating with said internal production bore;

a workover/annulus flow connection interconnecting said workover flowpath and said annulus flowpath; and a fluid passageway to the surface being formed by said common bore, production bore, tubing annulus, annulus flowpath, workover/annulus flow connection, workover flowpath, BOP bore, and one of said choke and kill lines.

34. A spool tree system for a wellhead for the completion and work-over of a subsea well, comprising:

a spool tree having a bore and for installation on the wellhead;

a tubing hanger suspending tubing and supported by said spool tree, seals sealing between said tubing hanger and said spool tree, said tubing having an internal production bore and forming a tubing annulus extending downwardly into the well;

said spool tree and tubing hanger forming a production flowpath in fluid communication with said internal production bore and having a production control valve controlling flow therethrough;

said spool tree forming an annulus flowpath in fluid communication with said tubing annulus and having an annulus control valve controlling flow therethrough;

a drilling blowout preventer having a BOP bore and a member for closing said BOP bore, a portion of said spool tree bore adapted to form a flow passageway with said BOP bore;

said spool tree having a workover flowpath communicating with said spool tree bore portion above said seals and below said BOP bore and having a workover valve controlling flow therethrough;

choke and kill lines connected to said drilling blowout preventer for communicating said BOP bore with the surface;

a workover/annulus flow connection interconnecting said workover flowpath and said annulus flowpath;

a pipe string extending to the surface and in fluid communication with said tubing hanger, said pipe string forming a common bore communicating with said internal production bore;

a crossover flowpath interconnecting said production flowpath and said workover/annulus flow connection said crossover flowpath having a crossover valve for controlling flow therethrough; and a fluid passageway being formed by said common bore, internal production bore, tubing annulus, annulus flowpath, workover/annulus flow connection, crossover flowpath, and production flowpath.

35. A spool tree system for a wellhead for the completion and work-over of a subsea well, comprising:

a spool tree having a bore and for installation on the wellhead;

a tubing hanger suspending tubing and supported by said spool tree, seals sealing between said tubing hanger and said spool tree, said tubing having an internal production bore and forming a tubing annulus extending downwardly into the well;

said spool tree and tubing hanger forming a production flowpath in fluid communication with said internal production bore and having a production control valve controlling flow therethrough;

said spool tree forming an annulus flowpath in fluid communication with said tubing annulus and having an annulus control valve controlling flow therethrough;

a drilling blowout preventer having a BOP bore and a member for closing said BOP bore, a portion of said spool tree bore adapted to form a flow passageway with said BOP bore;

said spool tree having a workover flowpath communicating with said spool tree bore portion above said seals and below said BOP bore and having a workover valve controlling flow therethrough;

choke and kill lines connected to said drilling blowout preventer for communicating said BOP bore with the surface;

a workover/annulus flow connection interconnecting said workover flowpath and said annulus flowpath;

a pipe string extending to the surface and in fluid communication with said tubing hanger, said pipe string forming a common bore communicating with said internal production bore;

a crossover flowpath interconnecting said production flowpath and said workover/annulus flow connection, said crossover flowpath having a crossover valve for controlling flow therethrough; and a fluid passageway being formed by one of said choke and kill lines, workover flowpath, workover/annulus flow connection, crossover flowpath, production flowpath, and common bore.

36. A spool tree svstem for a wellhead for the completion and work-over of a subsea well, comprising:

a spool tree having a bore and for installation on the wellhead;

a tubing hanger suspending tubing and supported by said spool tree, seals sealing between said tubing hanger and said spool tree, said tubing having an internal production bore and forming a tubing annulus extending downwardly into the well;

said spool tree and tubing hanger forming a production flowpath in fluid communication with said internal production bore and having a production control valve controlling flow therethrough;

said spool tree forming an annulus flowpath in fluid communication with said tubing annulus and having an annulus control valve controlling flow therethrough;

a drilling blowout preventer having a BOP bore and a member for closing said BOP bore, a portion of said spool tree bore adapted to form a flow passageway with said BOP bore;

said spool tree having a workover flowpath communicating with said spool tree bore portion above said seals and below said BOP bore and having a workover valve controlling flow therethrough;

choke and kill lines connected to said drilling blowout preventer for communicating said BOP bore with the surface;

a pipe string extending to the surface and in fluid communication with said tubing hanger, said pipe string forming a common bore communicating with said internal production bore;

a workover/annulus flow connection interconnecting said workover flowpath and said annulus flowpath; and said member being closed around said pipe string and further comprising a fluid passageway extending from the surface to the BOP bore through one of said choke and kill lines, another fluid passageway extending from the surface through said common bore, internal production bore, tubing annulus, annulus flowpath, workover/annulus flow connection, and workover flowpath to the BOP bore, and the other of said choke and kill lines extending from the BOP bore to the surface.

37. A spool tree assembly for use selectively with a blowout preventer having a BOP bore for operating a subsea well, comprising:

a spool body adapted for disposal below the blowout preventer and having a generally cylindrical internal wall forming a spool body central bore therethrough, a portion of said central bore being adapted to form a flow passageway with the BOP bore;

a tubing hanger assembly mounted in said spool body central bore and having a central passageway with a production passageway extending from said tubing hanger central passageway, an annulus being formed around said tubing hanger assembly;

said internal wall of said spool body having a production port in fluid communication with said production passageway, an annulus port in fluid communication with said annulus, and a workover port in fluid communication with said portion of said spool body central bore above said production passageway; and said annulus port and said workover port being in fluid communication externally of said spool body central bore.

* * * * *

UNITED STATES PATENT AND TRADEMARK OFFICE

CERTIFICATE OF CORRECTION

PATENT NO. : 6,039,119
DATED : March 23, 2000
INVENTOR(S) : Hans Paul Hopper, et al.

It is certified that error appears in the above-indentified patent and that said Letters Patent is hereby corrected as shown below:

Column 5, Line 64 change "shows" to --shown--;

Column 7, Line 22 after "spool" delete --,--;

Column 10, Line 22 change "theproducfion" to --the production--;

Column 14, Line 31 change "extena" to --external--; and

Column 16, Line 9 after "interconnecting" insert --said--.

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*